US006189471B1

(12) United States Patent
Mitchell et al.

(10) Patent No.: US 6,189,471 B1
(45) **Date of Patent: *Feb. 20, 2001**

(54) SAILBOATS AND METHODS

(76) Inventors: David N. Mitchell, 3140 S. Williams St., Englewood, CO (US) 80110; John W. Bradley, 5362 W. Capri, Littleton, CO (US) 80123; James H. Keesling, 3250 Cherry Ridge Rd., Englewood, CO (US) 80110

( * ) Notice: Under 35 U.S.C. 154(b), the term of this patent shall be extended for 0 days.

This patent is subject to a terminal disclaimer.

(21) Appl. No.: 09/454,613

(22) Filed: Dec. 6, 1999

Related U.S. Application Data

(63) Continuation of application No. 09/208,075, filed on Dec. 9, 1998, now Pat. No. 5,996,519, which is a continuation-in-part of application No. 09/031,502, filed on Feb. 26, 1998, now Pat. No. 5,988,086.

(51) Int. Cl.[7] ..... B63B 35/00; B63H 9/08

(52) U.S. Cl. ..... 114/39.21; 114/98; 114/102.15; 114/102.19; 114/102.21; 114/112; 114/204

(58) Field of Search ..... 114/39.21, 39.11, 114/99, 204, 94, 89, 98, 97, 223, 112, 111, 102.21, 102.2, 102.19, 102.18, 102.17, 102.16, 102.15, 102.1, 39.29

(56) References Cited

U.S. PATENT DOCUMENTS

| | | | |
|---|---|---|---|
| 1,856,803 | 5/1932 | Blackman . | |
| 1,891,555 | 12/1932 | Rockwood | 114/102.21 |
| 2,106,209 | 1/1938 | Edge | 114/39 |
| 2,795,203 | 6/1957 | Dupouy | 114/102.21 |
| 3,658,025 | 4/1972 | Hood et al. | 114/105 |
| 3,802,371 | 4/1974 | Jastrab | 114/102 |
| 3,851,609 | 12/1974 | Stearn | 114/105 |
| 3,867,894 | 2/1975 | Vicard | 114/102 |
| 3,948,200 | 4/1976 | Hood et al. | 114/105 |
| 4,263,861 | 4/1981 | Vicard | 114/39 |
| 4,345,535 | 8/1982 | Ross | 114/102.16 |
| 4,354,444 | 10/1982 | Puretic | 114/105 |
| 4,669,407 | 6/1987 | Cobb | 114/39 |
| 4,856,448 | 8/1989 | Peymann | 114/103 |
| 5,070,802 | 12/1991 | Corlett | 114/99 |
| 5,485,799 | 1/1996 | Julien | 114/103 |
| 5,603,276 | 2/1997 | Julien | 114/39.1 |
| 5,988,086 | 11/1999 | Mitchell et al. | 114/39.11 |
| 5,996,519 | 12/1999 | Mitchell et al. | 114/39.21 |

*Primary Examiner*—Sherman Basinger
(74) *Attorney, Agent, or Firm*—Townsend and Townsend and Crew LLP

(57) ABSTRACT

The invention provides various improved sailboats and methods for their use. In one exemplary embodiment, a sailboat comprises a hull and a deck that is operably attached to the hull. The deck has a longitudinal axis extending along its center. A mast is generally aligned with the longitudinal axis, and a luff cable is coupled to the mast and the deck. The luff cable is movable relative to the longitudinal axis. Further, a foresail is coupled to the luff cable such that at least a portion of the foresail is movable relative to the longitudinal axis upon movement of the luff cable.

29 Claims, 24 Drawing Sheets

SAILBOATS AND METHODS

CROSS REFERENCE TO RELATED APPLICATIONS

This application is a continuation and claims the benefit of U.S. application Ser. No. 09/208,075, filed Dec. 9, 1998 now U.S. Pat. No. 5,996,519 which is a continuation-in-part of U.S. application Ser. No. 09/031,502, filed Feb. 26, 1998, now U.S. Pat. No. 5,988,086 the disclosures of which are incorporated by reference.

This application is a continuation in part application of U.S. patent application Ser. No. 09/031,502, filed Feb. 26, 1998, the complete disclosure of which is herein incorporated by reference.

BACKGROUND OF THE INVENTION

The invention relates generally to the field of sailing. More specifically, the invention relates to the operation and management of sails on sailboats.

Sailing has long been a popular sport. One particular type of sailboat which is of interest to the present invention is illustrated generally in FIG. 1. It is identified by referenced numeral 10. Sailboat 10 comprises a hull (not shown) and a deck 12 disposed on top of the hull. At a back end of boat 10 is the stern 14, while at the front end is the fore peak 16. Extending between fore peak 16 and stern 14 (i.e., along a center of deck 12) is a central axis 18. Central axis 18 divides sailboat 10 into port side 20 and a starboard side 22. At the front end of sailboat 10 is the bow 24.

Extending generally vertically upward from deck 12 is a mast 26. Mast 26 is aligned with central axis 18 and is held in place by a forestay or headstay 28, a backstay 30, and pair of shrouds 32 and 34. However, it will be appreciated that multiple stays and shrouds may be employed in various arrangements and combinations. Forestay 28 is attached to deck 12 at a stemhead fitting 36 which lies on central axis 18. Since the opposite end of forestay 28 is attached to mast 26, forestay 28 is generally parallel with central axis 18. Backstay 30 is attached to deck 12 by a backstay fitting 38. At its opposite end, backstay 30 is attached to mast 26 at a masthead 40.

The current method for rigging a foresail, such as a jib, on sailboat 10 is by use of forestay 28. The foresail is raised along forestay 28 which in turn serves as the axis point for rotating the foresail. However, because forestay 28 has the additional function of securing mast 26, forestay 28 cannot be moved from its securing points on mast 26 and deck 12. Although a variety of methods may be employed to attach the foresail to headstay 28, headstay 28 remains the axis point of the foresail. Since headstay 28 is the attachment point of the foresail, the axis of rotation of the foresail is always fixed at central axis 18. Such a configuration can limit the usefulness of the foresail and its cooperation with the main sail. For example, in some cases the main sail may block a significant amount of wind from the foresail to limit the speed of the sail boat.

Another drawback to sailboat 10 is the difficulty encountered by a sailor when changing the foresail. Changing of the foresail with current rigging equipment requires one or more of the crew members to exit a cabin 42 and proceed onto bow 24 so that the foresail can be removed from forestay 28 and replaced with another sail. However, the addition of one or more crew members on the bow 24 will cause a change in the attitude of the boat in the water, thereby slowing the speed of the boat. Another disadvantage is that it may become dangerous for crew members to be positioned on bow 24, particularly when another sail also occupies bow 24. A further disadvantage is that it is time consuming to have a crew member exit cabin 42 and proceed to forestay 28 to change the sail. One significant disadvantage in changing foresails is that the speed of the boat is reduced because of the time in which no foresail is in place.

Hence, it would be desirable to provide improved sailboats which will greatly reduce or eliminate the problems associated with prior art sailboats. For example, in one embodiment, it would be desirable to provide a sailboat having a more versatile foresail arrangement and where the use of the foresail and its cooperation with the main sail were optimized. It would further be desirable to provide a more efficient way to manage the foresail, including providing an easy and convenient way to raise and lower the foresail.

SUMMARY OF THE INVENTION

The invention provides improved sailboats and methods for their construction and use. One important feature of at least some embodiments of the invention is that the foresail is provided with an axis of rotation (typically at the luff of the foresail) that can be located essentially anywhere on the bow of the boat. The axis of rotation of the foresail will preferably be variable so that its location may be varied both toward and away from a central axis of the boat as well as in the fore and aft directions. In this way, both the head and the tack of the foresail may be moved away from the longitudinal axis on both sides of the boat, regardless of the direction of the wind. As such, both the head and the tack may be moved to a windward side of the sailboat such that wind may engage the foresail and not be substantially blocked by the mainsail when traveling downwind. Preferably, such features will be provided by coupling the foresail to a wire, cable, line or the like which is separate from the forestay or headstay. In this way, the axis of rotation of the foresail may be located away from the central axis of the boat. Further, various tracks may be provided on the boat or the mast to allow for the location of the cable to which the foresail is attached to be varied.

In one exemplary embodiment, the invention provides a sailboat which comprises a hull and a deck which is operably attached to the hull. The deck includes a longitudinal axis which extends along a center of the deck. A mast is further provided and is generally aligned with the longitudinal axis. A luff cable is coupled to the mast and the deck, with the luff cable being movable relative to the longitudinal axis. Further, a foresail is coupled to the luff cable such that at least a portion of the foresail is movable relative to the longitudinal axis upon movement of the luff cable.

The luff cable is preferably coupled to the mast and the deck such that the luff cable can be moved toward and away from the central axis, in the fore and aft directions, or both. In this way, the location of the rotational axis of the foresail may be positioned essentially anywhere fore of the mast. With such a configuration, the speed of the sailboat may be increased regardless of the direction of the boat in relation to the wind. More importantly, such a configuration improves the direction of the sailboat relative to the direction of the wind.

Typically, the foresail includes a head, a tack, and a clue, with the foresail being coupled to a luff cable between the head and the tack. Preferably, the luff cable is movably coupled to the deck to allow the tack to be movable relative to the longitudinal axis. In another aspect, the luff cable may be movably coupled to the mast to allow the head of the foresail to be movable relative to the longitudinal axis.

In one particularly preferable aspect, a track is operably attached to the deck, with at least a portion of the track being at an angle relative to the longitudinal axis. The luff cable is coupled to the track so that the location of the luff cable along the bow of the deck may be varied. The track may be disposed at various locations along the deck and may have various configurations, including straight tracks, angled tracks, curved tracks and the like. For example, the track may be conveniently disposed about a periphery of the deck. Typically, a carriage will be coupled to the track, with the luff cable being coupled to the carriage. The carriage may be moved by one or more lines or cables that are coupled to the carriage. Alternatively, the carriage may move along the track depending on the direction of the wind to allow the foresail to automatically adjust its position depending on the wind direction.

In one alternative aspect, a turret is rotatably coupled to the deck, and an arm is translatably coupled to the turret. The luff cable is coupled to the arm to allow the tack of the foresail to be moved both rotationally and radially relative to the turret. Use of such a turret is particularly advantageous in that it may be employed to move the tack of the foresail to an angle of up to approximately 45 to 50 degrees relative to the mast and the longitudinal axis to allow the boat to sail into the wind. Further, the tack of the foresail may be retracted when moving the tack to the other side of the boat so that the tack will not interfere with the forestay.

In still another alternative, a sprit pole is coupled to both the port side and the starboard side of the sailboat. A line extends between the sprit poles, and the tack is movably coupled to the line. In this way, the position of the tack may be varied by moving the tack along the line. Conveniently, positioning of the tack along the line may be accomplished by allowing the tack to move along the line depending on the direction of the wind. Preferably, the sprit poles are translatable relative to the hull to increase the distance that the tack is positioned away from the mast.

In still a further aspect, a plurality of attachment points may be provided on the deck which are offset from the longitudinal axis. In this way, the luff cable may be manually attached to the attachment points to vary the location of the tack relative to the longitudinal axis.

The sailboat preferably also includes a mainsail that is coupled to the mast. A boom is also coupled to the mainsail to move the mainsail as is known in the art. Further, a boom pole is coupled to the boom to adjust the orientation of the mainsail. Use of the boom pole is particularly advantageous in that it allows the mainsail to be positioned at an orientation having the same general relationship between the mainsail and the foresail as presently exists with conventional sailboats so that full advantage can be taken of this relationship.

In another exemplary aspect, a track is also operably attached to the mast to raise and lower the luff cable relative to the mast. An adjustment mechanism is preferably coupled to the mast track to vary the location of the luff cable relative to the longitudinal axis. For example, the adjustment mechanism may comprise a cross member having a track to which the luff cable is coupled. The cross member is movably coupled to the mast track so that the cross member may be raised and lowered. To move the luff cable toward or away from the central axis, the luff cable is simply moved along the track of the cross member. Alternatively, the adjustment mechanism may comprise a pivotable strut which is coupled to the mast track. In this way, the luff cable may be moved in a variety of directions relative to the mast.

In one aspect, a cable of fixed length is coupled to the mast track at a location that is different from the strut. The other end of the cable is attached to the foresail. In this way, as the strut is moved along the track relative to the cable, the position of the head of the foresail relative to the mast is adjusted. Such a configuration is particularly advantageous in that the strut may be moved inside the forestay so that the head of the foresail may be moved to the opposite side of the sailboat without interfering with the forestay. Once the foresail is moved to the opposite side of the boat, the strut is moved further along the track to move the head of the foresail away from the mast. The head of the foresail may also be moved by coupling a line or cable to the shroud and the strut. The line may then be manipulated to adjust the position of the head of the foresail relative to the mast helping tension the luff cable of the foresail.

The foresail is preferably raised by moving the luff cable along the deck in a direction generally toward the fore peak while also moving the luff cable up the mast until tension is provided to the luff cable. Once the sail is raised, the location of the luff cable may be varied along the bow of the deck to vary the location of the tack. Optionally, the location of the luff cable may also be varied relative to the mast to vary the location of the head of the foresail. As with conventional sailboats, the location of the clew may also be varied as is known in the art. In this way, an almost infinite variety of sail locations may be provided to optimize the cooperation of the foresail with the main sail. Advantageously, the deck track and the mast track may terminate in the vicinity of the cockpit or cabin so that the foresail may be raised or lowered while the crew remain within or near the cabin area. In this way, excessive weight is not transferred to the bow of the boat. Further, the need for placing crew members on the bow of the deck is eliminated.

In another exemplary embodiment, the invention provides a sailboat which comprises a hull and a deck that is operably attached to the hull. The deck has a longitudinal axis that extends along the center of the deck. A mast is generally aligned with the longitudinal axis. Further, at least two tracks are disposed on the deck and on the mast. In this way, each of the tracks may be used to raise or lower a different foresail. In this manner, operation of the sailboat may be optimized since one sail may remain raised while raising another sail. Once the second sail is raised, the first sail may be lowered and removed. As an alternative to using tracks, a pair of pulleys may be coupled to the mask and the deck to allow two foresails to be separately raised and lowered.

Preferably, a luff cable is attached to each of the tracks and is coupled to one of the foresails. In this way, each foresail may be raised by moving the luff cable along one of the deck tracks and up one of the mast tracks. In another aspect, the deck tracks are disposed on opposite sides of the longitudinal axis. In some cases, the tracks on the deck and the mast intersect each other at a point aligned with the longitudinal axis so that the head and the tack of the foresail remain on the longitudinal axis when fully raised. In a further aspect, at least a portion of the deck tracks are disposed at an angle relative to the longitudinal axis. In this way, the foresail may be moved both toward and away from the longitudinal axis so that the rotational axis of the foresail may be varied. In still another aspect, an adjustable strut or cross member may be coupled to at least one of the mast tracks so that the luff cable may be moved either toward or away from the mast when coupled to the adjustable strut or cross member. Conveniently, the mast track or tracks and the deck track or tracks may begin near the cockpit so that the various foresails may be raised and lowered while the crew remain in or near the cabin area.

In another embodiment, the invention provides a sailboat comprising a hull and a deck operably attached to the hull, with the deck having a longitudinal axis extending along a center of the deck. A mast extends from the deck and is generally aligned with the longitudinal axis. A boom is pivotally coupled to the mast. The sailboat further includes a foresail having a head, a tack and a clew. The head of the foresail is operably coupled to the mast using one of the methods described herein and the tack is operably coupled to the boom. In this way, the tack is movable in an operating direction that is different from a longitudinal direction defined by the longitudinal axis by pivoting the boom about the mast.

Optionally, the boom includes an extension, and the tack is coupled to the extension. In this way, the tack may be moved toward or away from the mast by translating the extension. Preferably, the sailboat further includes a track that is coupled to the deck, a carriage that is coupled to the track, and a boom pole that is pivotally coupled to the boom and the carriage. A mechanism is also provided for moving the carriage along the track. In this way, the orientation of the foresail may be varied simply by moving the position of the carriage along the track.

The invention further provides an exemplary method for retrofitting a sailboat to accommodate a foresail having a variable foresail axis. According to the method, a track is coupled to a deck of the sailboat as well as to a mast of the sailboat. In this way, the foresail may be raised and lowered by coupling the foresail to a luff cable and moving the luff cable along the deck track and the mast track. Preferably, at least a portion of the deck track is at an angle relative to a longitudinal axis of the boat so that the foresail may be movable relative to the longitudinal axis. Optionally, two or more deck tracks may be coupled to both the deck and the mast to allow separate foresails to be separately raised and lowered.

DESCRIPTION OF THE PREFERRED EMBODIMENTS

The invention provides exemplary sailboats and methods for their construction and use. The features of the invention will find their greatest use with sailboats having one hull. However, it will be appreciated that the invention may also be useful with sailboats having multiple hulls, e.g. catamaran sailboats. One important feature of the invention is that it provides a way to vary the location of the rotational axis of the foresail (which is typically at the luff of the foresail) relative to the sailboat. In this way, the use of the foresail and its cooperation with the main sail may be optimized so that boat speed may be increased regardless of wind direction. The location of the rotational axis of the foresail is preferably varied by moving the location of the tack and/or head of the foresail. In certain preferred embodiments, the location of the rotational axis of the foresail is made variable by attaching the foresail to a luff cable, wire, line and the like and varying the attachment points of the luff cable on the deck and/or the mast. In this way, the rotation of the axis of the foresail may be placed in an almost infinite variety of orientations simply by moving the luff cable to different locations relative to the deck and/or relative to the mast. More specifically, the attachment points of the luff cable to the mast and the deck may be moved either fore, aft, toward, or away from the central axis of the sailboat to vary the orientation and location of the rotational axis of the foresail.

Another important feature of the invention is that it provides a convenient way to raise a foresail. This is preferably accomplished by providing a track along the deck and a track along the mast, with the two tracks terminating near the cockpit or cabin of the sailboat. In this way, the luff cable (having the foresail attached) can be moved along the deck toward the fore peak and up the mast to provide tension to the luff cable and raise the foresail. In this manner, a sailor need not exit the cabin or cockpit to raise or lower the foresail. Further, such a configuration allows the foresail to be raised and lowered more efficiently and more safely and can provide significant advantages when racing the sailboat.

Still another important feature of the invention is that the sailboats may be provided with two or more sets of tracks on the deck and the mast. In this way, two or more sails may be separately operated. For example, one foresail may remain raised while preparing to raise another foresail. Once the other foresail is raised, the first foresail may be lowered. In this manner, the sailboat will essentially always have a foresail available for operation.

Figure 1:
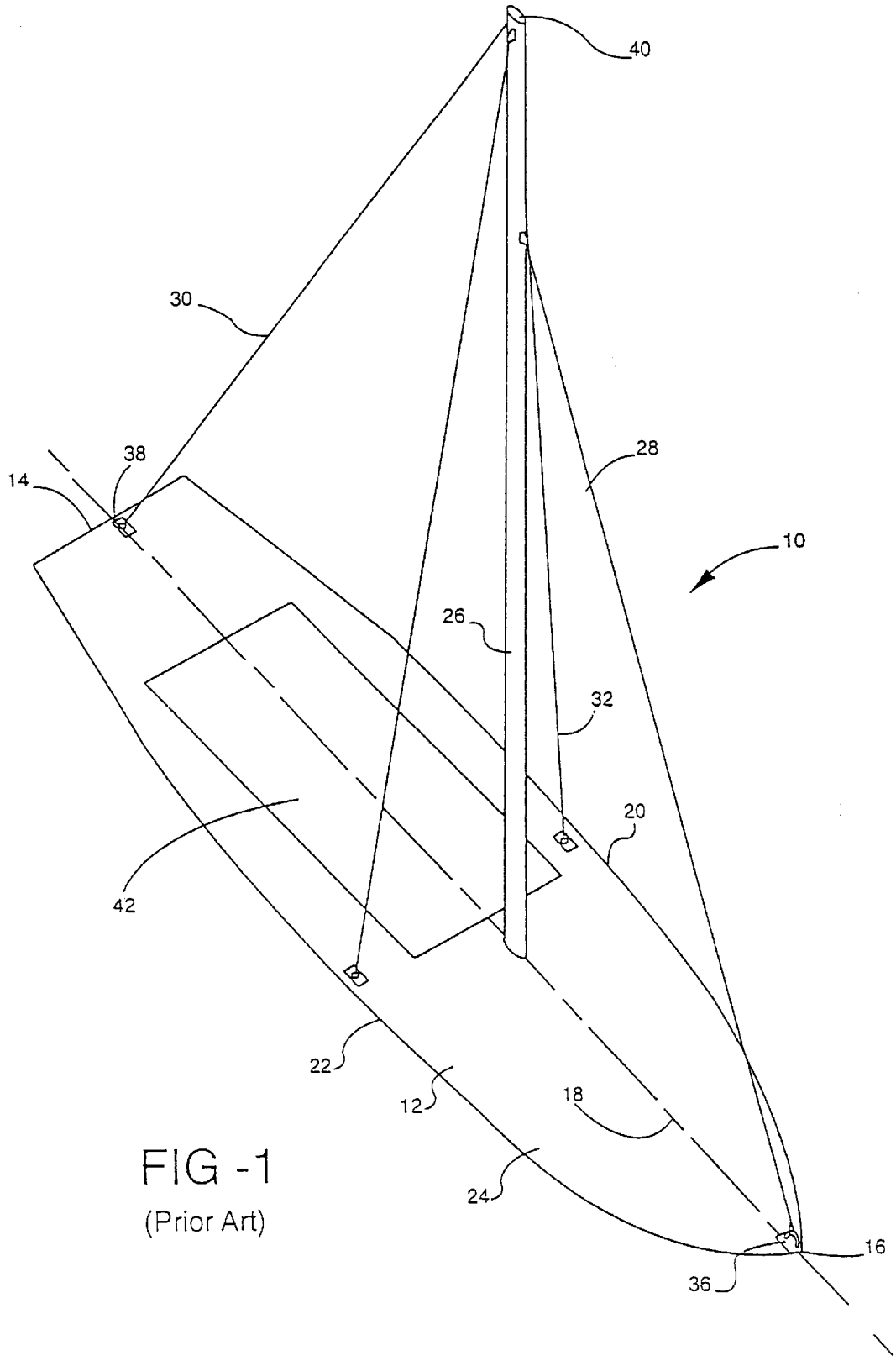
FIG -1 (Prior Art)
FIG. 1 illustrates a prior art sailboat having a mast secured by a forestay and a backstay which are aligned with a central axis of the sailboat.
Figure 2:
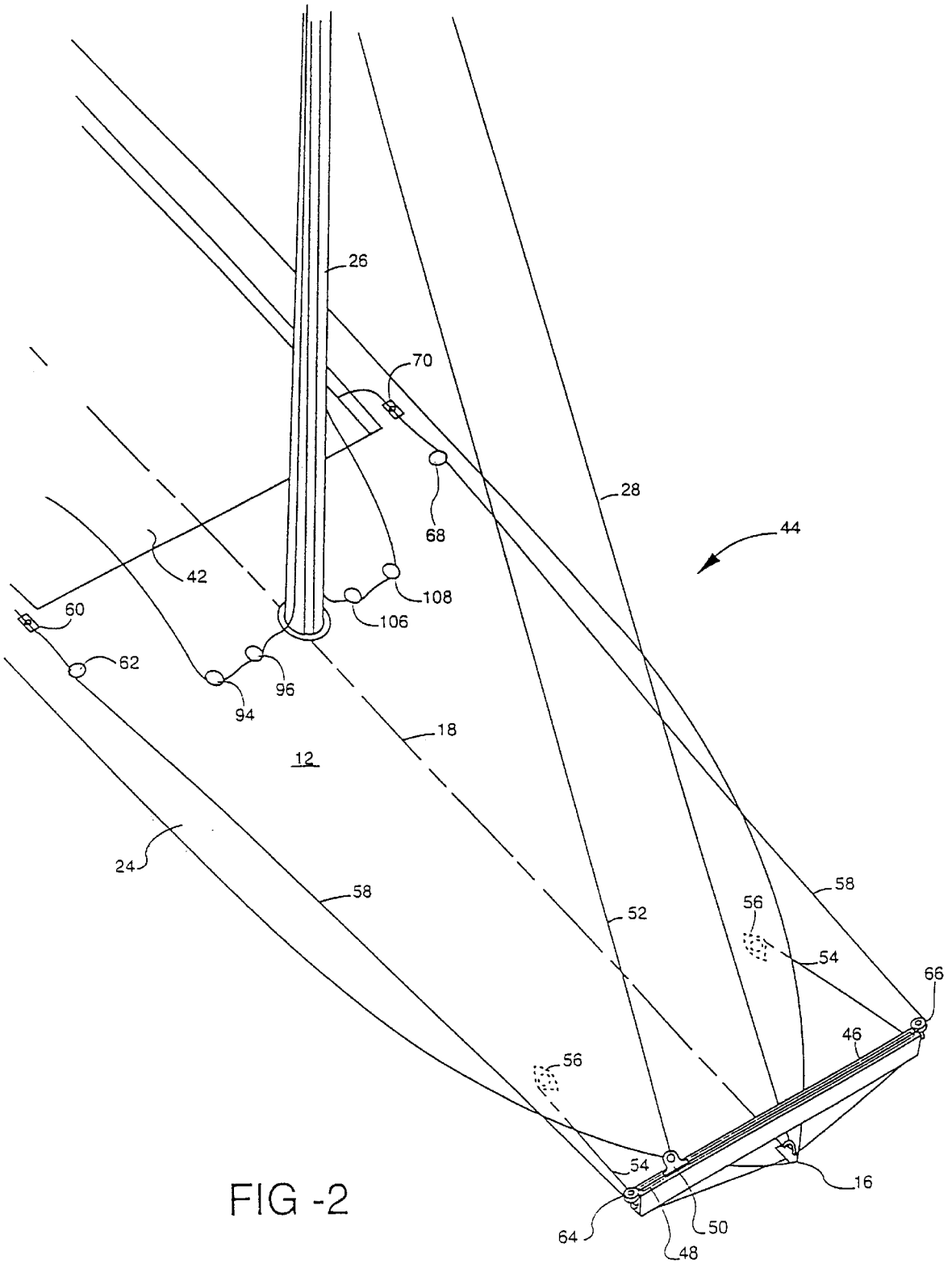
FIG. 2 illustrates a bow of a sailboat having a track to vary the location of a luff cable to which a foresail may be attached according to the invention.

Referring now to FIG. 2, an exemplary embodiment of a sailboat 44 will be described. Sailboat 44 is constructed of various elements that are essentially identical to sailboat 10 of FIG. 1. For convenience of discussion, identical elements of all embodiments described herein will be described using the same reference numerals as used to describe sailboat 10.

Attached to deck 12 near forepeak 16 is a support 46 having a track 48. Track 48 as well as the other tracks described herein may be any one of a variety of commercially available tracks, such as those commercially available from Harken, Inc. Track 48 is generally perpendicular to central axis 18, although track 48 could be arranged at other angles relative to central axis 18 and can also be provided with other geometries, such as curved, angled, elliptical, and the like. Coupled to track 48 is a carriage 50 which is movable along track 48. Coupled to carriage 50 is a luff cable 52. Although not shown, luff cable 52 will typically have a foresail operably attached thereto. In this way, luff cable 52 serves as the rotational axis for the foresail. As carriage 50 is moved along track 48, luff cable 52 is also moved to move the location of the rotational axis of the foresail. Conveniently, support 46 is secured to sailboat 44 by guy wires 54 which in turn are coupled to a pair of chain plates 56 (shown in phantom line) on the hull of the sailboat.

Carriage 50 is moved along track 48 by operating a control cable 58. Control cable 58 extends from cabin 42, around a cleat 60, adjacent a sheave 62 on deck 12, around another sheave 64 on support 46, and then to carriage 50. From carriage 50, control cable 58 extends around another sheave 66, to a sheave 68, around a cleat 70, and back into cabin 42. In this manner, carriage 50 may be moved along track 48 simply by releasing control cable 58 from cleats 60 and 70 and pulling on either end of control cable 58.

Figure 3:
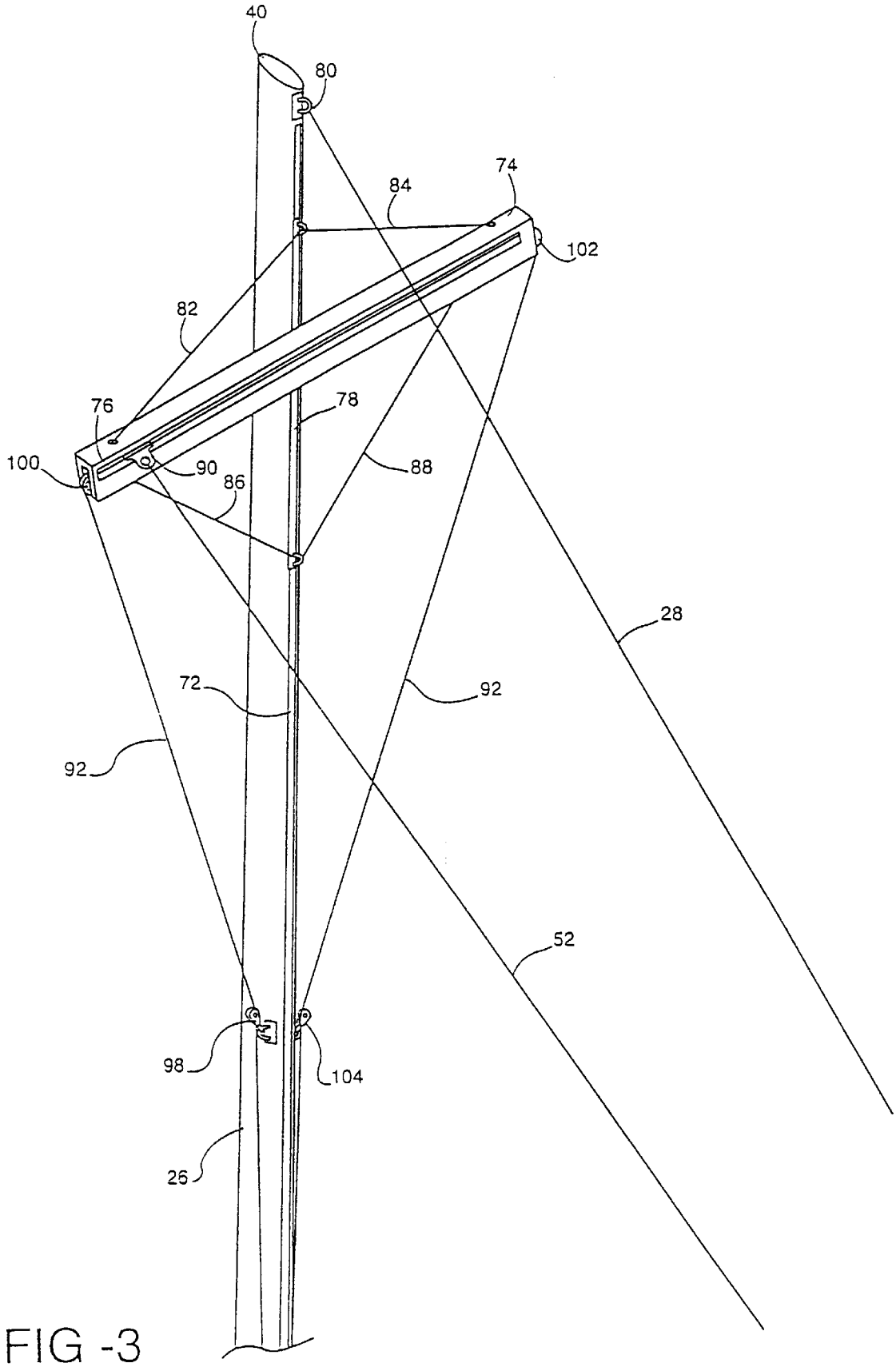
FIG. 3 illustrates a top end of the mast of the sailboat of FIG. 2 having a cross member with a track for varying the location of the luff cable relative to the mast according to the invention.

As best shown in FIGS. 2 and 3, mast 26 includes a track 72 which allows luff cable 52 to be raised and lowered as described hereinafter. Coupled to track 72 by an elongate carriage 78 is a cross-member 74. A track 76 is disposed on cross-member 74. Carriage 78 is movable along track 72 so that it may move cross-member 74 up and down mast 26. An eyelet 80 is provided at masthead 40. A pulley (not shown) is coupled to eyelet 80 SO that a cable (not shown) may be disposed within track 76 (or within mast 26 or along side of mast 26) and extend around the pulley to allow the cable to be used to lift carriage 78, and thus move cross-member 74. To lower cross-member 74, the cable (not shown) is simply released, allowing carriage 78 (and thus cross-member 74) to move down track 72 by force of gravity. In some cases, carriage 78 may be lowered by pulling on the foresail or by using a cable that is coupled to carriage 78. Conveniently, a set of guy wires 82–88 are provided to secure cross-member 74 to carriage 78. In this way, cross-member 74 is stabilized relative to mast 26.

Coupled to track 76 of cross-member 74 is a carriage 90. Attached to carriage 90 is luff cable 52. As carriage 90 is moved along track 76, the horizontal location of luff cable 52 is varied. As previously described, the other end of luff cable 52 is coupled to carriage 50 on support 46 (see FIG. 2). In this way, the position of luff cable 52 relative to the sailboat may be varied either by moving carriage 50 or carriage 90, or both, so that a wide variety of orientations for luff cable 52 may be obtained. In this manner, the rotational axis of the foresail can be moved to a variety of locations in an easy and convenient manner.

Still referring to FIGS. 2 and 3, carriage 90 is moved along track 76 by use of a control cable 92. Control cable 92 initiates within cabin 42 and extends around a pair sheaves 94 and 96 where it is directed upward on mast 26. Control cable 92 is coupled to mast 26 by a sheave 98. From sheave 98, control cable 92 extends to a sheave 100 on cross-member 74. Control cable 92 is then coupled to carriage 90 and then extends to a sheave 102 at an opposite end of cross-member 74. Finally, control cable 92 passes around sheaves 104–108 until terminating within cabin 42. In this manner, a sailor within cabin 42 may move carriage 90 along track 76 by simply pulling on either end of control cable 92 while remaining within cabin 42.

Figure 4:
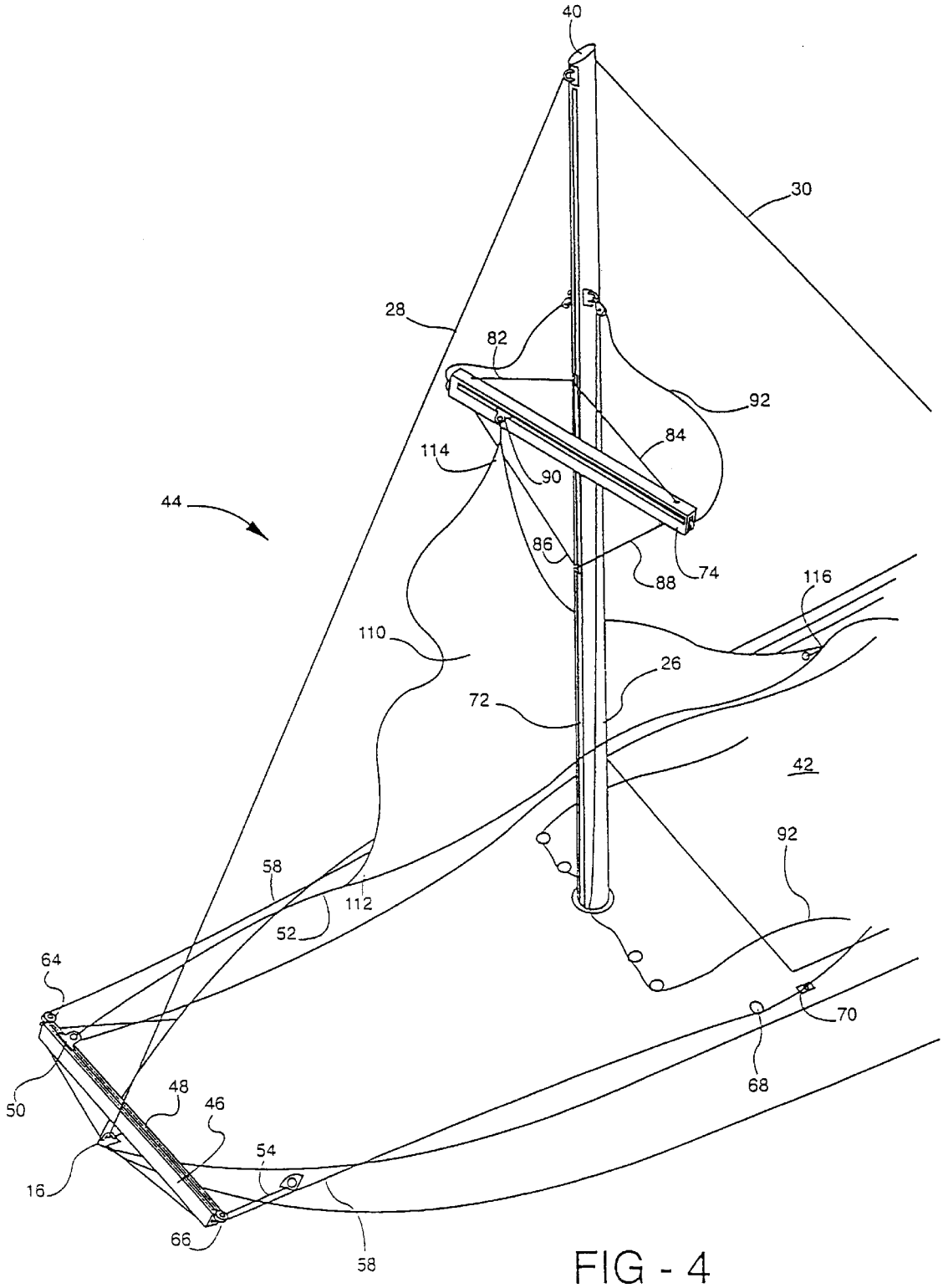
FIG. 4 illustrates the sailboat of FIGS. 2 and 3 showing a method for raising a foresail using the luff cable according to the invention.
Figure 5:
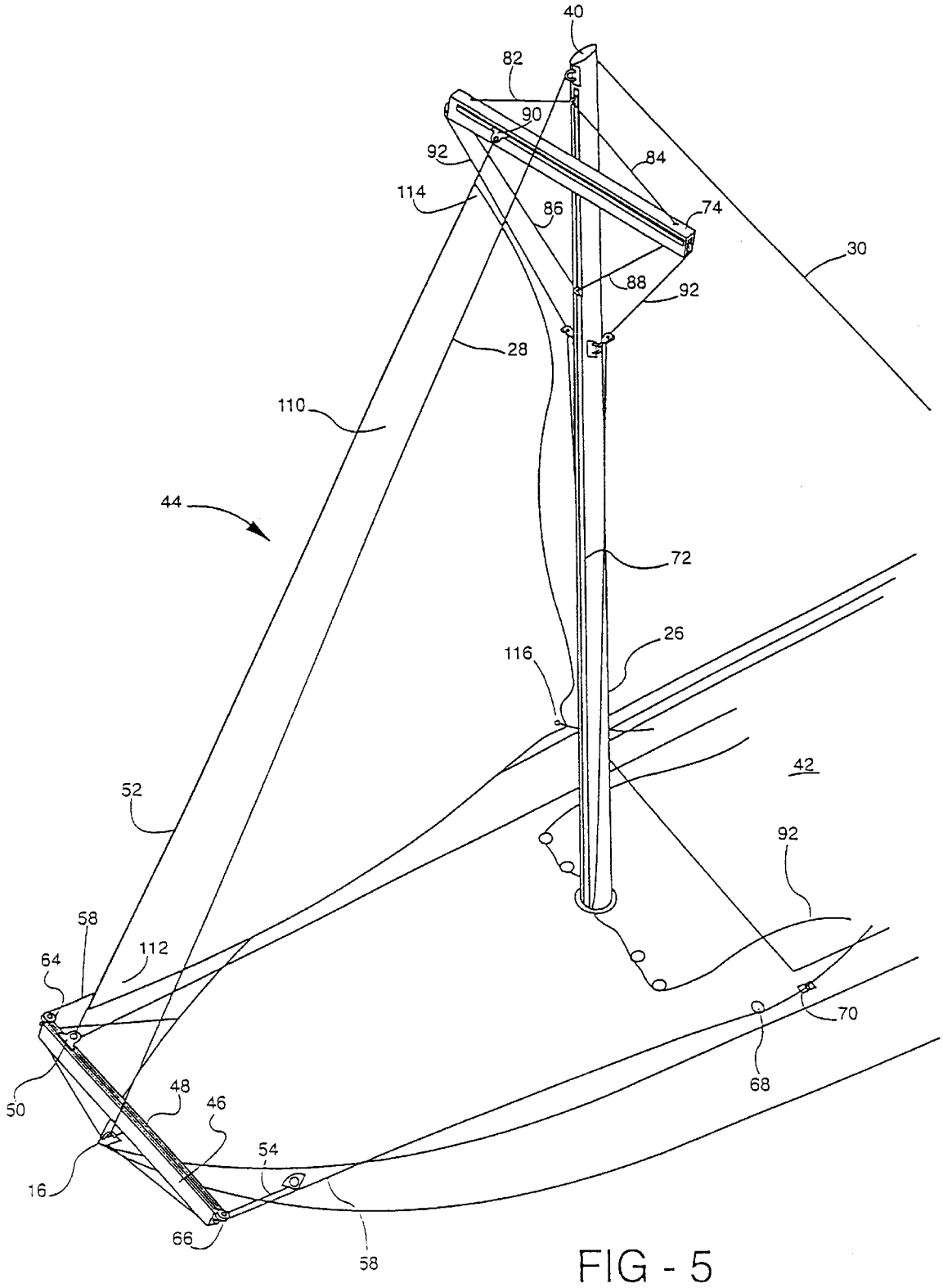
FIG. 5 illustrates the sailboat of FIG. 4 when the foresail is completely raised.

Referring now to FIGS. 4 and 5, an exemplary method for raising a foresail 110 on sailboat 44 will be described. Foresail 110 includes a tack 112, a head 114, and a clew 116. Luff cable 52 is attached to foresail 110 between tack 112 and head 114 as shown. Luff cable 52 is initially threaded through carriage 50 and brought back within cabin 42. The other end of luff cable 52 is coupled to carriage 90. Preferably, cross-member 74 is lowered along track 72 so that luff cable 52 may be coupled to carriage 90 from within cabin 42. Luff cable 52 is then pulled from within cabin 42 to move tack 112 toward carriage 50. Cross-member 74 is also raised along track 72 to move head 114 upwardly along mast 26. This process is continued until luff cable 52 has the desired tension as illustrated in FIG. 5. At any time, carriage 50 and/or carriage 90 may be moved to change the orientation of luff cable 52 and foresail 110. As previously described, the orientation of luff cable 52 may be varied within the cabin by manipulating control cable 58 and/or control cable 92.

Figure 6:
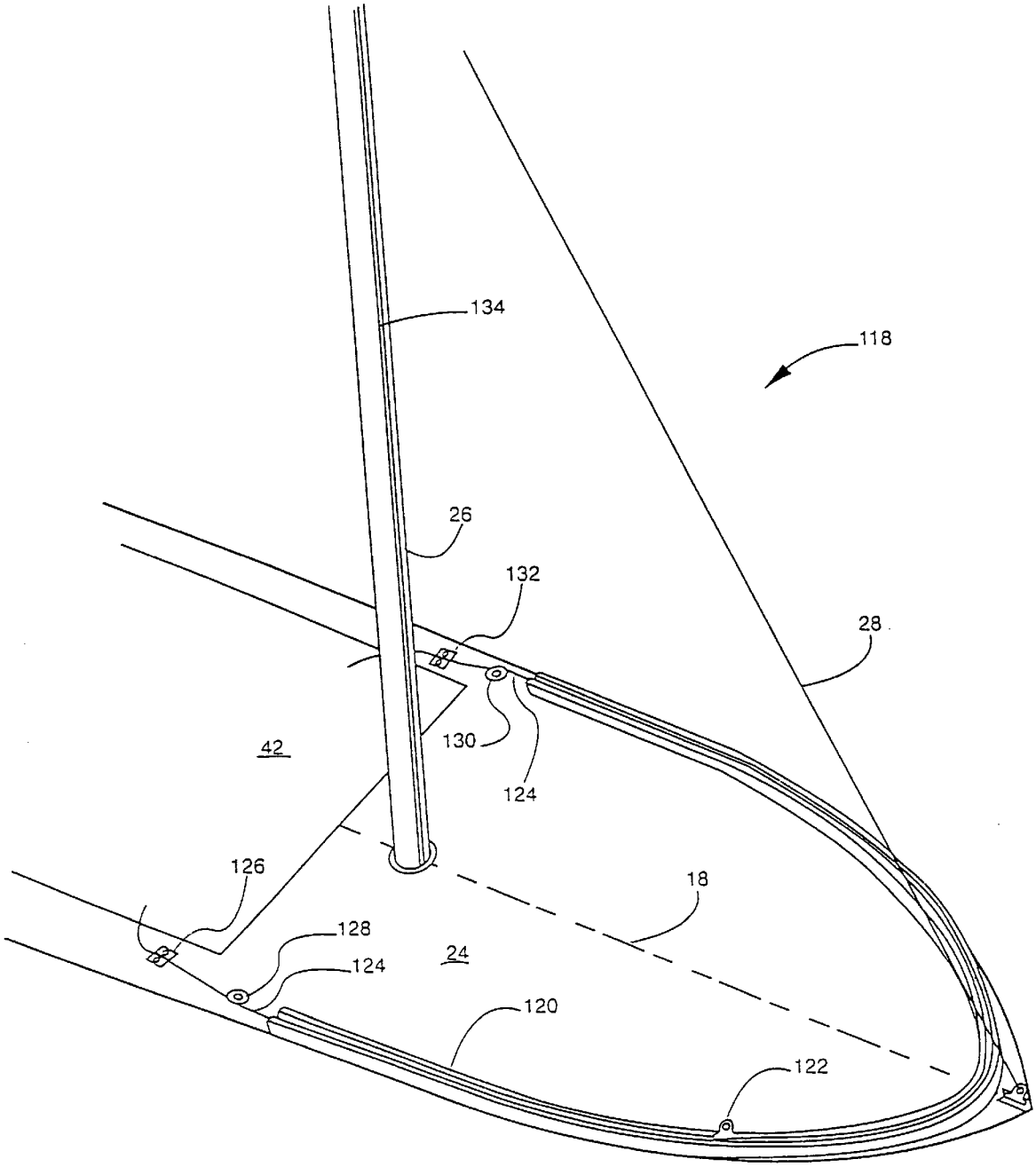
FIG. 6 illustrates another embodiment of a sailboat having a track disposed about a periphery of the deck to vary the location of a luff cable to which a foresail may be operably attached according to the invention.

Referring to FIG. 6, an alternative embodiment of a sailboat 118 will be described. Sailboat 118 includes a track 120 which extends about the periphery of bow 24. Coupled to track 120 is a carriage 122 to which a luff cable may be attached to vary the rotational axis of a foresail similar to that previously described with sailboat 44.

Carriage 122 is moved along track 120 by use of a control cable 124. Control cable 124 extends from cabin 42, along a cleat 126, along a sheave 128, and to carriage 122. From carriage 122, control cable 124 runs back along a sheave 130 and a cleat 132 where it terminates within cabin 42. In this way, a sailor may move carriage 122 along track 120 by pulling on control cable 124 while remaining within cabin 42.

Mast 26 includes a track 134 which is used to raise and lower the other end of the luff cable similar to sailboat 44. Instead of employing a cross-member to raise the luff cable on mast 26, a simple carriage may be coupled to track 134 to raise or lower the luff cable (not shown). As another alternative, an adjustable strut 136 (see FIGS. 7 and 12) may be employed to allow the location of the luff cable to be varied relative to the mast. Adjustable strut 136 will be described in greater detail with reference to FIG. 12.

Figure 7:
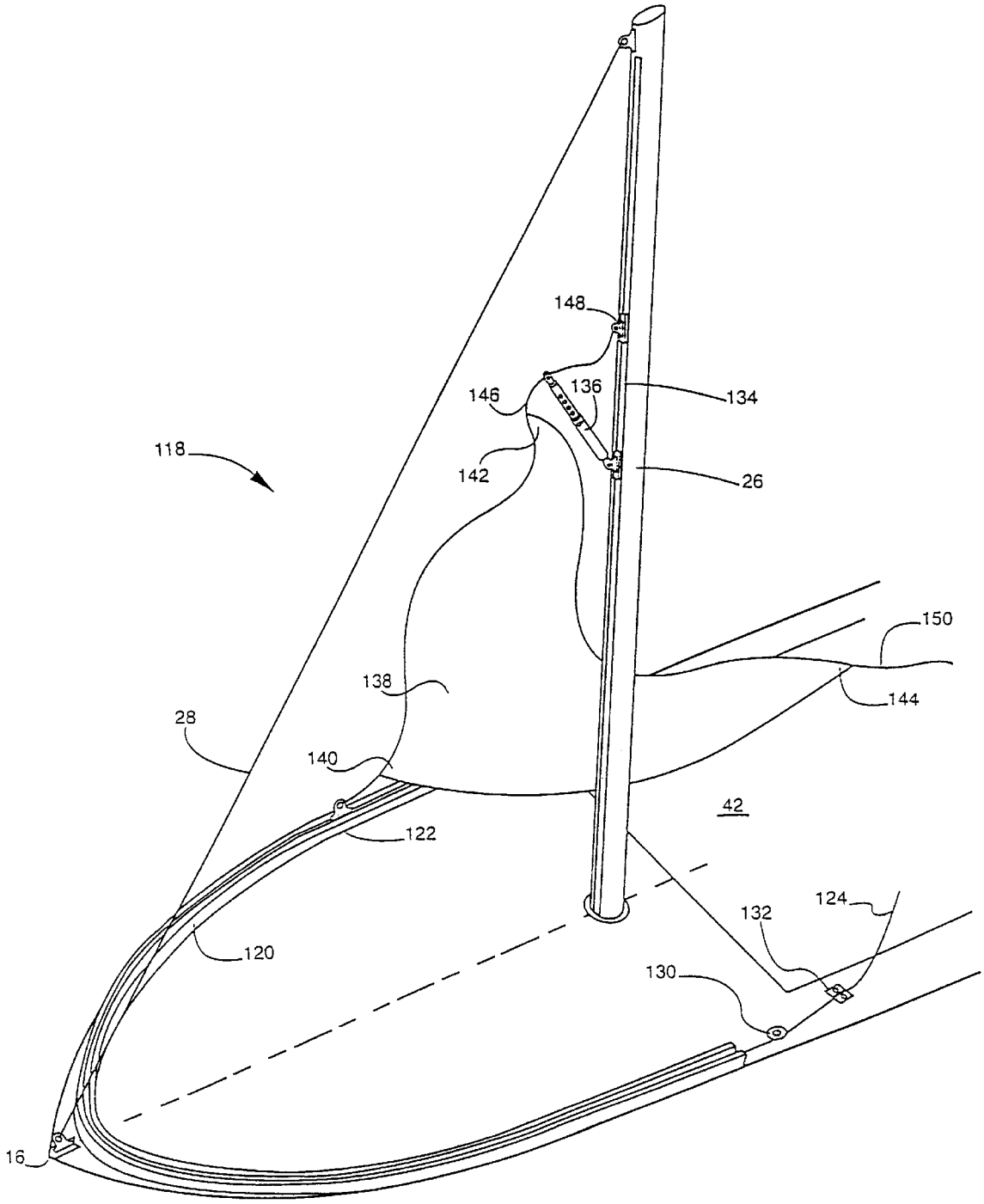
FIGS. 7 and 8 illustrate an exemplary method for raising a foresail using the luff cable and track of FIG. 6.
Figure 8:
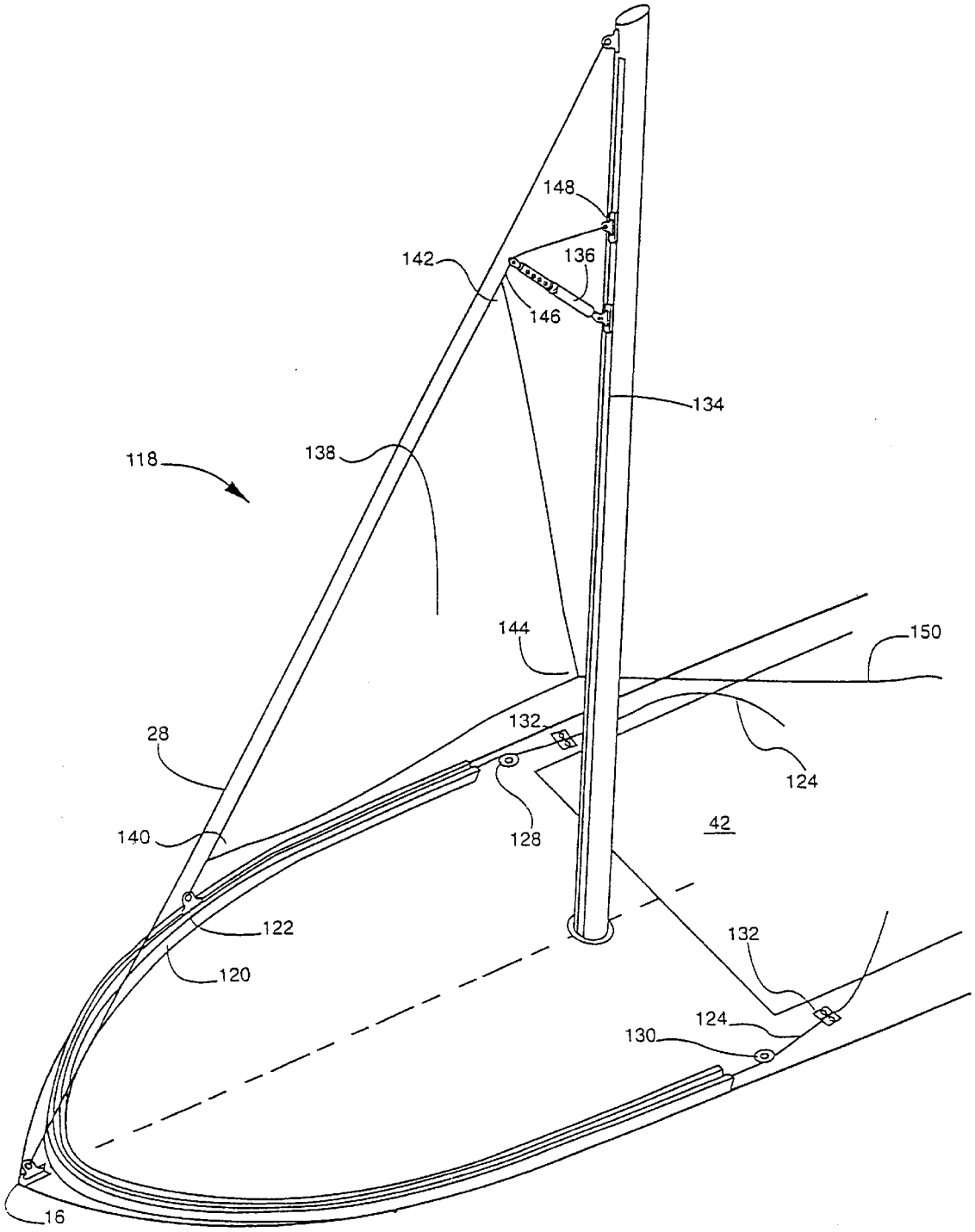

Referring now to FIGS. 7 and 8, an exemplary method for raising a foresail 138 on sailboat 118 will be described. Foresail 138 includes a tack 140, a head 142, and a clew 144. Foresail 138 is attached to a luff cable 146 between head 142 and tack 140. Luff cable 146 is attached to carriage 122, preferably while carriage 122 is dislocated near sheave 128 or sheave 130. In this way, a sailor need not exit cabin 42 in order to attach luff cable 146 to carriage 122. The other end of luff cable 146 (i.e., near head 142) is attached to a carriage 148 which is coupled to track 134. Luff cable 146 is preferably attached to carriage 148 while carriage 148 is lowered so that coupling or attachment may occur from within cabin 42. Control cable 124 is then pulled from within cabin 42 to move carriage 122 toward forepeak 16 shown in FIG. 8. Carriage 122 may be stopped anywhere along track 120 depending on where it is desired to locate foresail 138. Carriage 148 is also raised up track 134 until proper tension is provided in luff cable 146. Carriage 148 is raised using a cable (not shown) which runs the length of mast 26. As described in greater detail with reference to FIG. 12, adjustable strut 136 allows for the location of head 142 to be varied relative to mast 26. In this way, luff cable 146 may be placed in a wide variety of orientations so that the rotational axis of foresail 138 may be greatly varied. Further, a line 150 is attached to clew 144 as is known in the art to vary the location of clew 144.

Figure 9:
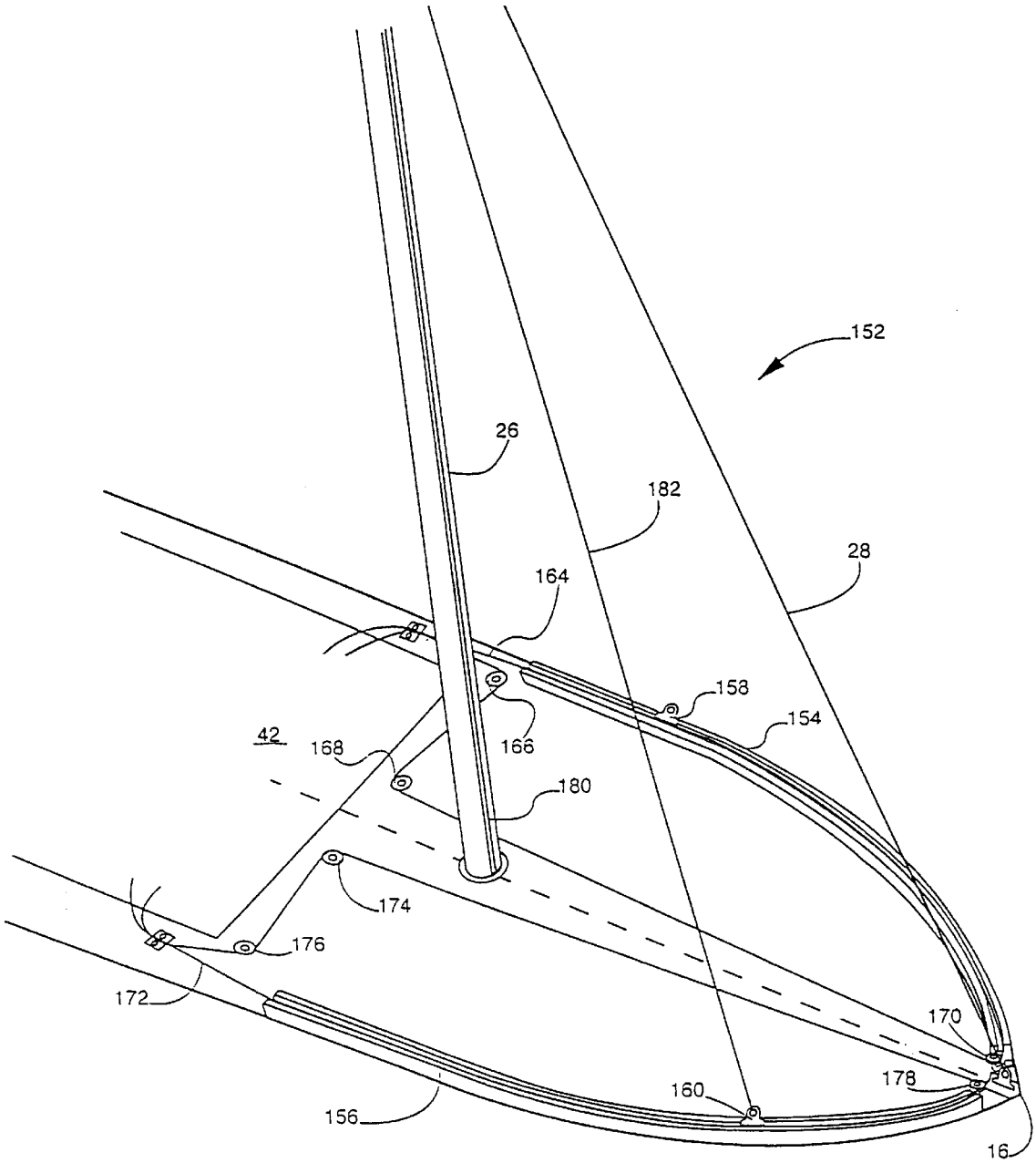
FIG. 9 illustrates another exemplary embodiment of a sailboat having a track disposed on the port side and a track disposed on the starboard side to which a luff cable may be coupled according to the invention.

Referring now to FIG. 9, still another embodiment of a sailboat 152 will be described. Sailboat 152 includes a port track 154 and a starboard track 156. Coupled to port track 154 is a carriage 158, and coupled to starboard track 156 is a carriage 160. In this manner, a luff cable 182 may be attached either to carriage 158 or carriage 160, or both. With this arrangement, the rotational axis of the foresail may be varied on the port side using carriage 158 or on the starboard side using carriage 160. Further, use of two separate tracks with two separate luff cables allows for two foresails to be separately raised and lowered in a manner similar to that described hereinafter with reference to FIG. 11.

Carriage 158 is moved along track 154 using a control cable 164. Cable 164 is routed around a pair of turning blocks 166 and 168 and around a sheave 170. Similarly, carriage 160 is moved by a control cable 172 which is routed around a pair of turning blocks 174, 176 and a sheave 178. In this way, either control cable 164 or control cable 172 may be operated from within cabin 42 to move the rotational axis of the foresail. Mast 26 includes a track 180 for raising or lowering luff cable 182 in a manner similar to that described with previous embodiments.

Figure 10:
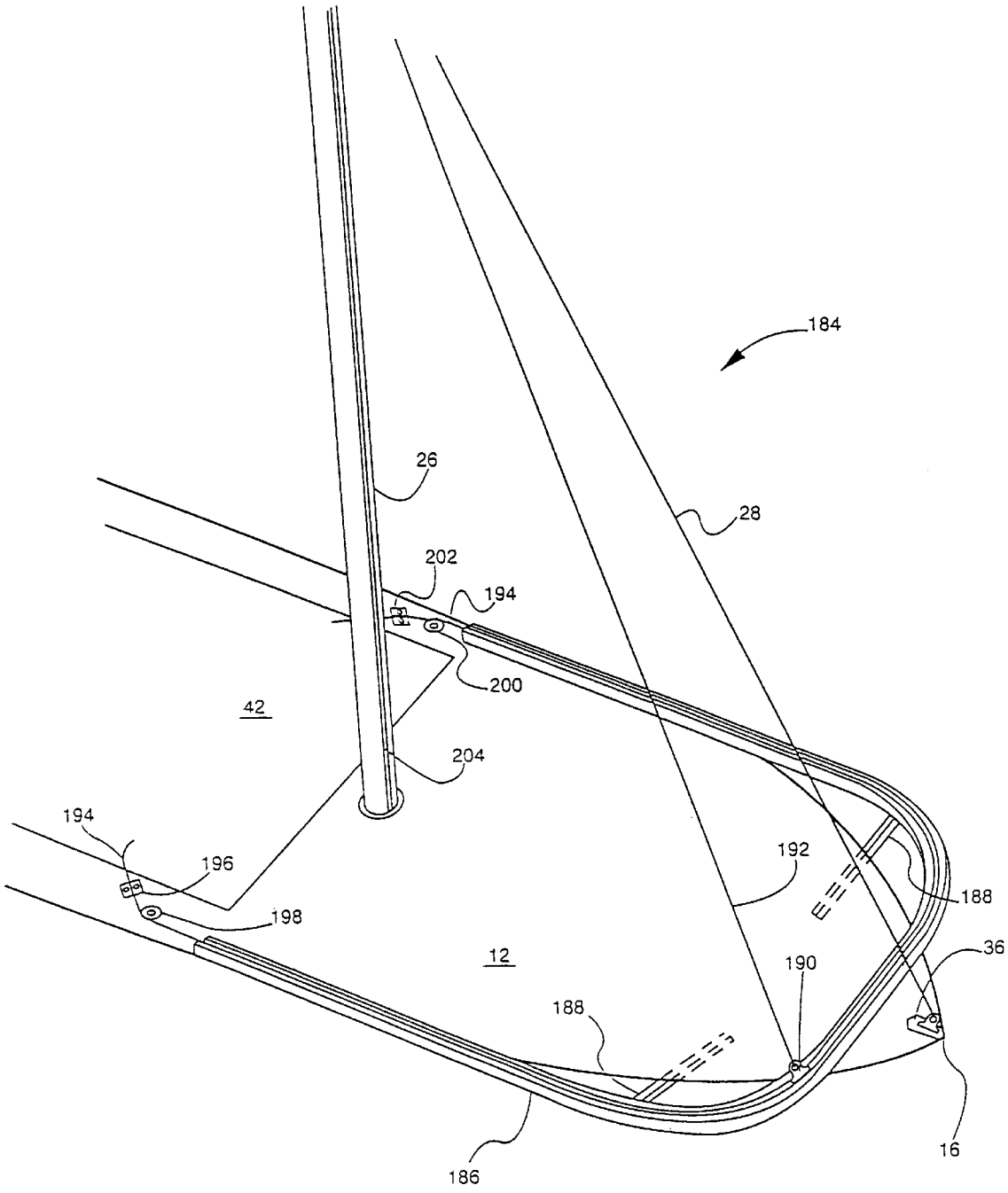
FIG. 10 illustrates still another embodiment of a sailboat having a track for adjusting the location of a luff cable to which a foresail may be attached according to the invention.

Referring to FIG. 10, still another embodiment of a sailboat 184 will be described. Sailboat 184 includes a track 186 that extends beyond the deck 12. Track 186 is supported by a pair of supports 188. Coupled to track 186 is a carriage 190 which in turn is coupled to a luff cable 192. As with other embodiments, carriage 190 may be moved about track 186 to vary the rotational axis of the foresail. Carriage 190 is moved along track 186 by operating a control cable 194. Control cable 194 begins in cabin 42 and extends along a cleat 196 and a sheave 198 before reaching carriage 190. Control cable 194 then extends past a sheave 200, along a cleat 202 and back into cabin 42. In this way, carriage 190 may be moved from within cabin 42. Mast 26 includes a track 204 for raising or lowering the other end of luff cable 192 in a manner similar to other embodiments to raise or lower the foresail.

Figure 11:
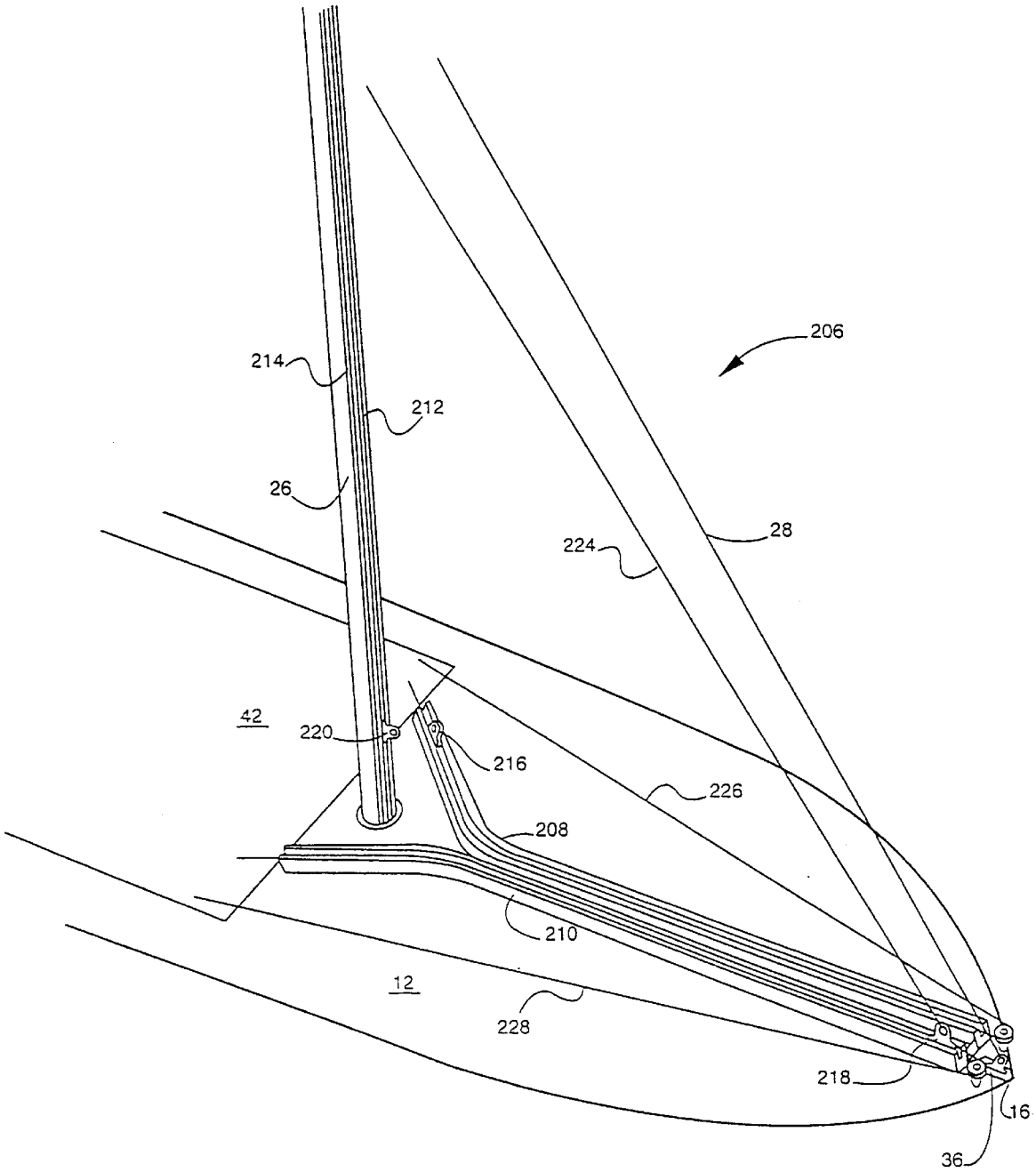
FIG. 11 illustrates still yet another embodiment of a sailboat having a pair of tracks on the deck and a pair of tracks on the mast to allow two foresails to be separately raised and lowered according to the invention.

Referring to FIG. 11, still yet another embodiment of a sailboat 206 will be described. Sailboat 206 includes a pair of deck tracks 208, 210 and a pair of mast tracks 212, 214. Coupled to each of tracks 208–214 is a carriage 216–222, respectively (with carriage 222 being illustrated in FIG. 12). Carriage 216 operates in cooperation with carriage 220 to raise a foresail that is attached to a luff cable (not shown). Similarly, carriage 218 works in combination with carriage 222 to raise and lower a foresail using a luff cable 224. In this way, two sails may be separately raised and lowered while remaining within cabin 42. Such a system is particularly advantageous when changing sails since one sail may remain raised while the other is loaded onto the carriages. Once the second sail is raised, the first sail may be lowered so that at least one foresail is operating at all times. Further, although not shown, the orientation of the deck tracks may be varied along deck 12 so that the rotational axis of the foresail may be varied as described in previous embodiments.

Carriage 216 is moved along track 208 by a control cable 226 while carriage 218 is moved along track 210 by a control cable 228. Carriages 220 and 222 are raised and lowered using control cables (not shown) which may be positioned about sheaves disposed on mast 26.

Figure 12:
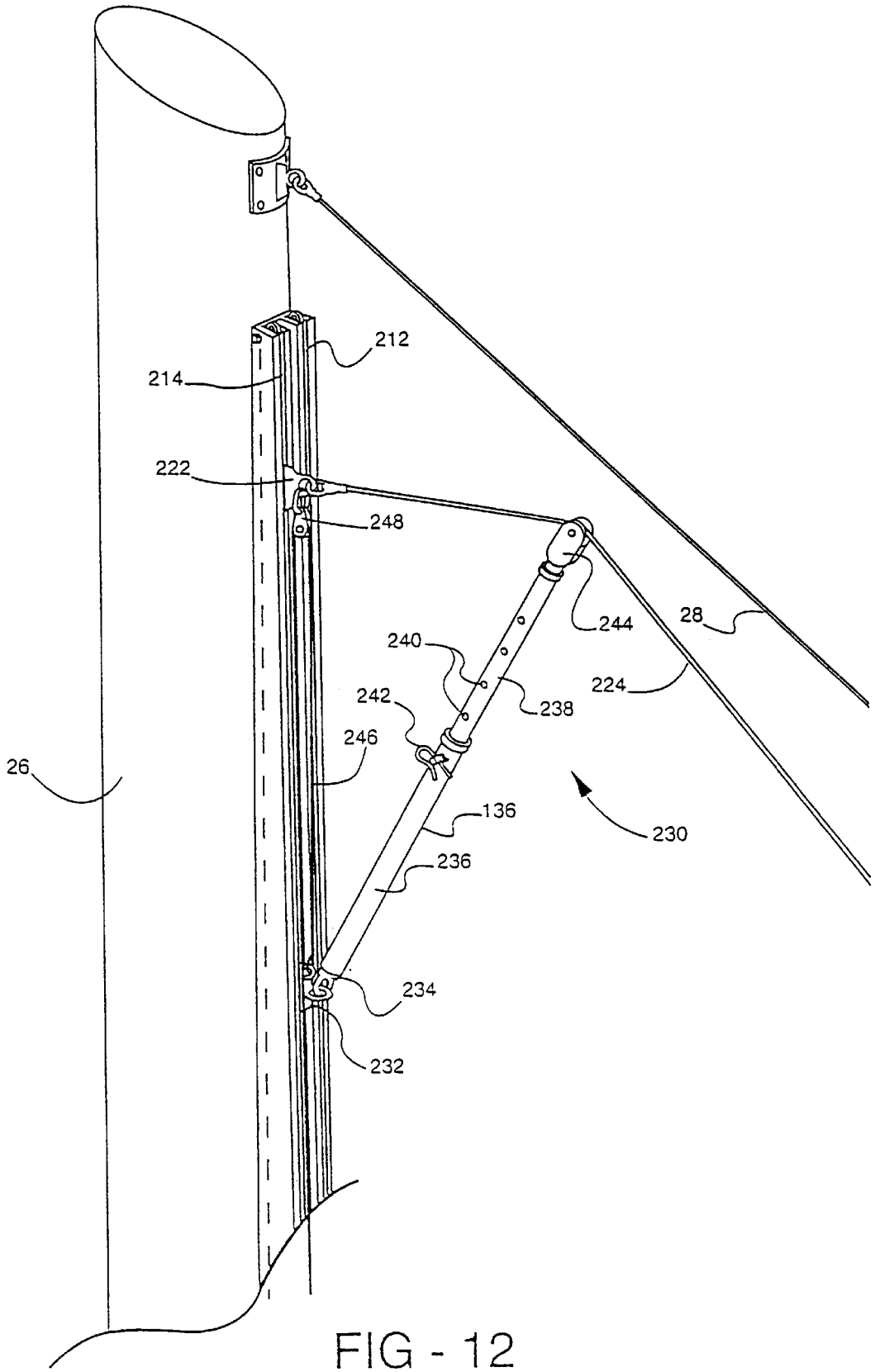
FIG. 12 illustrates a top end of the mast of FIG. 11 showing an adjustable strut to allow variation in the location of the luff cable relative to the mast according to the invention.

Referring now to FIG. 12, an adjustment mechanism 230 for adjusting the location of luff cable 224 will be described. Adjustment mechanism 230 comprises adjustable strut 136 having a loop 234 (or other attachment mechanism) which is coupled to a carriage 232 on track 214. In this way, strut 136 may be pivoted about a wide variety of angles relative to mast 26. Adjustable strut 136 comprises a tubular body 236 and a shaft 238. Shaft 238 is provided with a plurality of holes 240 into which a pin and clip 242 may be placed to vary the length of strut 136. With such a configuration, a way is provided to vary the offset of luff cable 224 relative to the centerline of the boat. Connected to shaft 238 is a pulley 244 upon which luff cable 224 is guided.

Carriage 222 is connected to carriage 232 by a control cable 246. Control cable 246 passes around a pulley 248 so that the distance between carriages 222 and 232 may be varied by pulling on control cable 246 while remaining within cabin 42. Although not shown, other control cables may be provided to control movement of strut 136 to control lateral movement, i.e., toward and away from central axis 18.

Although not shown, an adjustable strut similar to strut 136 may be provided on track 212. Alternatively, tracks 212 and 214 may be provided with a cross-member similar to the cross-member of FIG. 3 to vary the location of luff cable 224.

Figure 13:
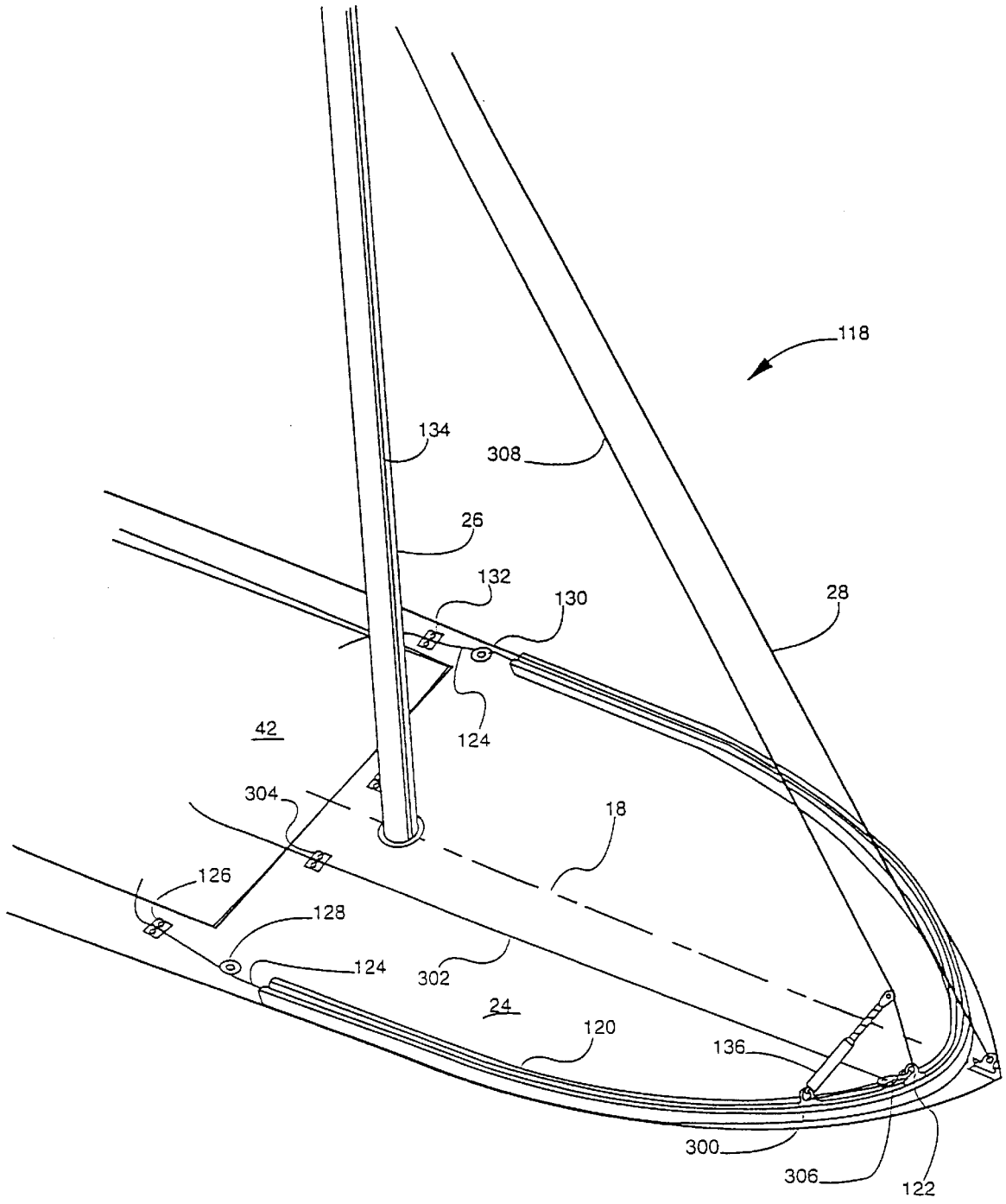
FIG. 13 illustrates the sailboat of FIG. 6 having an adjustable strut coupled to a deck track according to the invention.

As illustrated in FIG. 13, adjustable strut 136 may also be used with sailboat 118 of FIG. 6. To accommodate strut 136, a carriage 300 is coupled to track 120 and strut 136 is pivotally coupled to carriage 300. A control cable 302 which begins in cabin 42 extends past a cleat 304, around a pulley 306 and to carriage 300. In this way, a crew member may tighten or loosen cable 302 to vary the location of carriage 300 relative to carriage 122. In so doing, the crew member is able to adjust both the tension in and the orientation of a luff cable 308. Although not shown, carriage 300 (or another carriage) may be placed on the port side and operated with a separate control cable in a similar manner.

Figure 14:
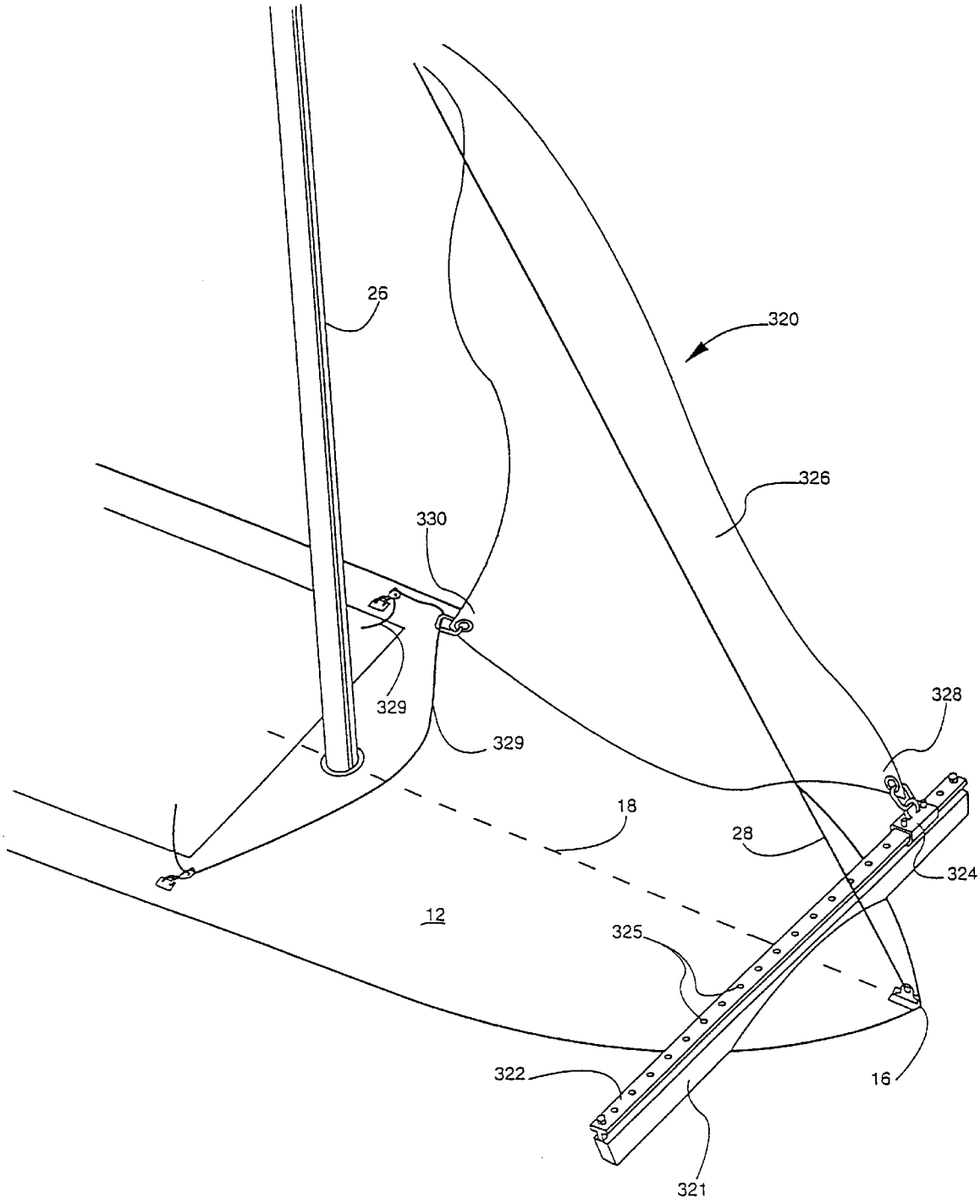
FIG. 14 illustrates an alternative sailboat having a track to vary the location of the tack of a foresail according to the invention.

Referring now to FIG. 14, an alternative embodiment of a sailboat 320 will be described. Attached to deck 12 is a support 321 having a track 322 to which a carriage 324 is coupled. Support 321 is coupled to deck 12 in any conventional manner. Hence, one advantage of sailboat 320 is the ease in adding support 321 and track 322. Sailboat 320 further includes a foresail 326 having a head (not shown), a tack 328 and a clew 330. Tack 328 is coupled to carriage 324. Carriage 324 in turn is coupled to track 322 in a manner such that carriage 324 may slide along track 322. In this way, carriage 324 will slide to a given position along track 322 depending on the direction of the wind. In this way, tack 328 will be positioned at a preferred location without the use of any cables or lines. Rather, the wind itself moves tack 328 to the proper position.

The head of foresail 326 may be coupled to mast 26 using any of the attachment schemes described herein. Conveniently, a pair of sheets 329 are attached to clew 330 to adjust the position of clew 330. Optionally, track 322 includes a plurality of openings 325 that are distributed along the length of track 322. Stops, such as pegs, may be placed in selected openings to control the length of travel of carriage 324 along track 322 or to fix its position.

For convenience of discussion, the position of tack 328 may be defined in terms of an angle lying between central axis 18 and a line extending from tack 328 to the center line of mast 26. The length of track 322 may be adjusted (or stops may be used within openings 325) to adjust this angle. For example, track 322 may have a length sufficient to create an angle of at least 45 degrees, as previously defined. For convenience of discussion, such an angle will hereinafter be referred to as the operating angle.

One particular advantage of sailboat 320 (as well as the other embodiments of sailboats described herein) is the ability to move the tack back to weather to expose more of the foresail. In this way, to accomplish a broad reach, the foresail may be moved so as not to have the mainsail block its wind.

Figure 15:
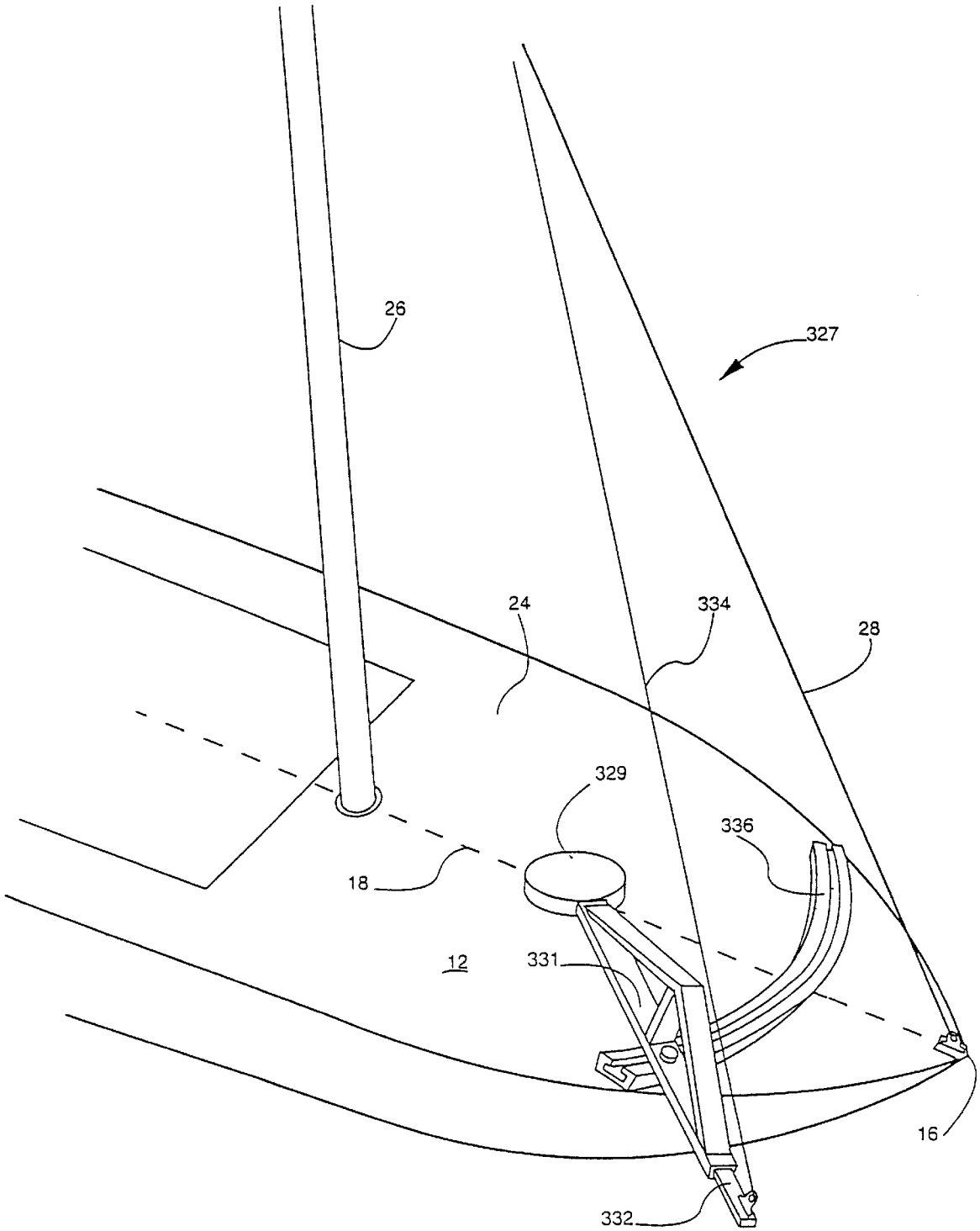
FIG. 15 illustrates another alternative sailboat having a rotatable turret and a translatable arm to vary the location of a luff cable to which a foresail may be attached according to the invention.

Shown in FIG. 15 is another alternative embodiment of a sailboat 327. Rotatably coupled to deck 12 is a turret 329. Extending from turret 329 is a frame 331 which includes a translatable arm 332. Coupled to arm 332 is a luff cable 334. Luff cable 334 is configured to be coupled to a foresail (not shown) similar to other embodiments described herein. As such, luff cable 334 may be attached to mast 26 according to any of the schemes described herein. Deck 12 includes a curved slot 336 for receiving an extension on frame 331. In this way, slot 336 serves to maintain frame 331 coupled to deck 12 when forces are exerted on frame 331 by the foresail. The construction of frame 331 also serves to maintain the integrity of the frame during operation.

One particular advantage of employing turret 329 in combination with arm 332 is that two degrees of motion may be obtained, i.e., a rotational degree of motion and a translational degree of motion. In this way, luff cable 334 may be rotated and/or translated so that the position of the foresail may be varied. Turret 329 and arm 332 may be configured to operate in a manner similar to that described in U.S. Pat. No. 4,630,327, the complete disclosure of which is herein incorporated by reference.

Another advantage of employing turret 329 and arm 332 is that a large operating angle may be produced without requiring extensive equipment extending beyond deck 12. Another advantage is that arm 332 may be retracted when turret 329 moves luff cable 334 between the port and starboard sides of the sailboat. In this way, luff cable 334 will not become engaged with or interfere with forestay 28 as the foresail is changed to an opposite side of the boat.

Figure 16:
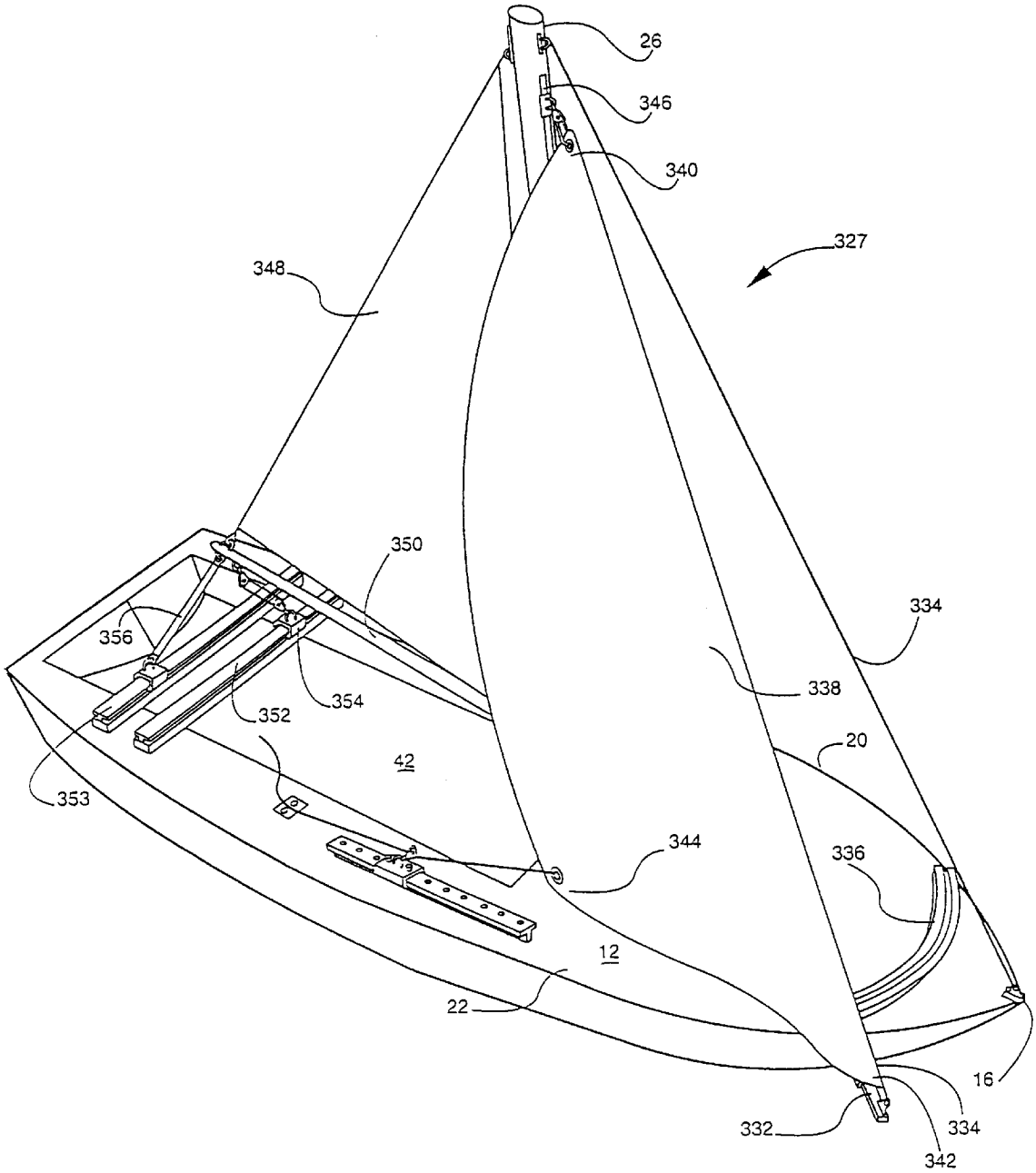
FIG. 16 illustrates the sailboat of FIG. 15 having a foresail attached to the luff cable and having a boom pole for adjusting the location of a mainsail according to the invention.

FIG. 16 illustrates sailboat 327 having a foresail 338 coupled to luff cable 334. Foresail 338 includes a head 340, a tack 342 and a clew 344. Conveniently, mast 26 includes a track 346 which allows head 340 to be raised and lowered.

Sailboat 327 further includes a mainsail 348 which is coupled to mast 26. Coupled to a bottom of mainsail 348 is a boom 350. Tracks 352 and 353 are attached to deck 12 and a traveler 354 is provided on track 352 to control movement of boom 350 as is known in the art. According to the invention, a boom pole 356 extends between track 353 and boom 350 to also allow for the adjustment of the position of boom 350. Boom pole 356 is particularly advantageous in maintaining the same spatial orientation between mainsail 348 and foresail 338. More specifically, when sailboat 327 is moving into the wind, tack 342 and clew 344 will be positioned at a desired orientation. In many cases, it is desirable to have the tack and clew of mainsail 348 have the same relative positions. However, the head wind will tend to swing mainsail 348 (in this case, toward starboard side 22). By employing boom pole 356, boom 350 may be forced back toward port side 20 so that mainsail 348 will have the desired spatial orientation with foresail 338.

Although boom pole 356 is shown as being coupled to track 353, it will be appreciated that boom pole 356 may be coupled to other locations on sailboat 327. Merely by way of example, boom pole 356 may be attached to the bottom of cabin 42.

Figure 17:
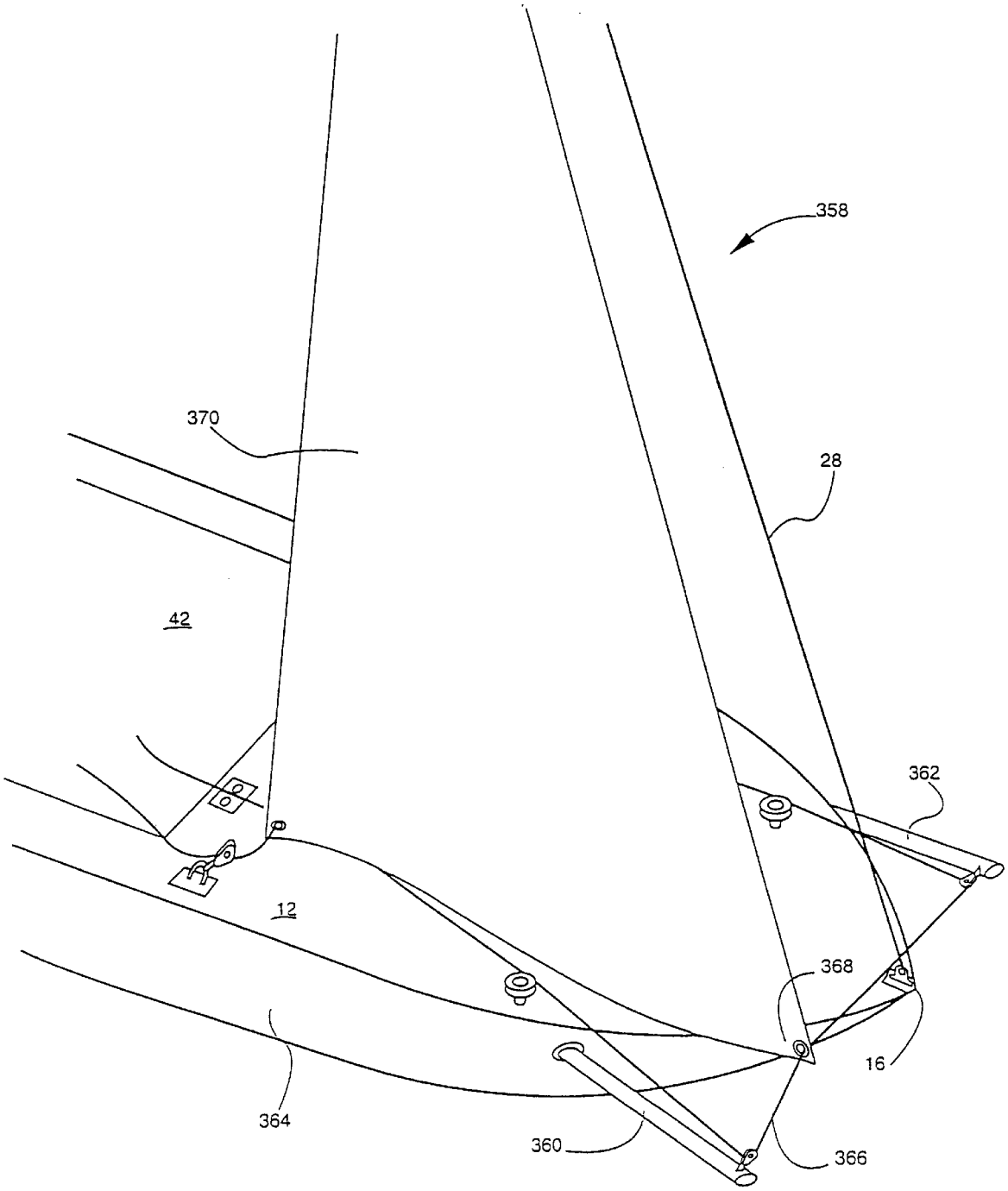
FIG. 17 illustrates still another embodiment of a sailboat having a pair of sprits and a line extending between the sprits to which the tack of a foresail is coupled according to the invention.

Referring now to FIG. 17, an alternative embodiment of a sailboat 358 will be described. Sailboat 358 includes a pair of sprit poles 360 and 362 extending from a hull of sailboat 358. Extending between sprit poles 360 and 362 is a line 366. Line 366 is in turn coupled to a tack 368 of a foresail 370. In this way, the location of tack 368 may be varied by pulling on either end of line 366.

Sprit poles 360 and 362 may be configured to be fixed relative to hull 364 or maybe extendable. In this way, the position of tack 368 relative to forepeak 16 may be varied by adjusting the amount of extension of poles 360 and 362.

In one alternative, a fixed line may be placed between poles 360 and 362. In this way, tack 368 may slide over the line as dictated by the direction of the wind similar to the embodiment of FIG. 14. As another alternative, tack 368 may be directly attached to the end of either sprit pole 360 or 362. In still another embodiment, a track may be positioned between sprit poles 360 and 362. This may be accomplished, by placing the track between the poles while the sailboat is docked.

One particular advantage of using retractable sprit poles is that the poles may be retracted when not in use. Further, the sprit poles may be extended so that the operating angle may be as great as 45 degrees. Still further, use of sprit poles 360 and 362 allows tack 368 to be moved as close as possible to forepeak 16 without having the foresail interfere with forestay 28 when being moved to opposite sides of the sailboat.

Figure 18:
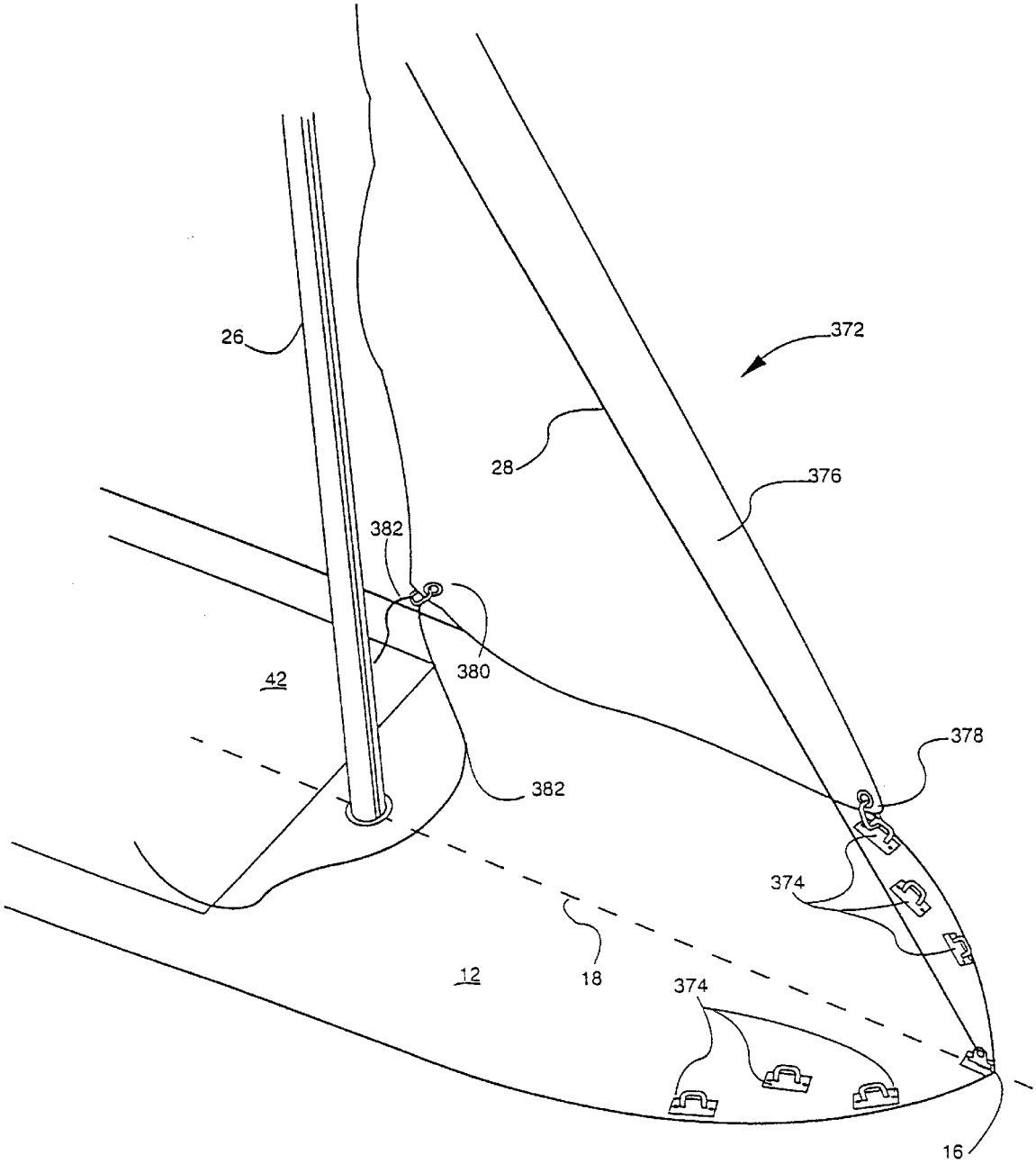
FIG. 18 illustrates an embodiment of a sailboat having multiple attachment points on the bow of the deck for attaching the tack of the foresail according to the invention.

Referring to FIG. 18, still another embodiment of a sailboat 372 will be described. Attached to deck 12 are a plurality of attachment points 374 that are offset from center line 18. It will be appreciated that the number and location of attachment points 374 may vary depending on the particular need. Sailboat 372 further includes a foresail 376 having a head (not shown), a tack 378 and a clew 380. Tack 378 is coupled to one of attachment points 374 so that tack 378 is offset from center line 18. Depending on the desired location of foresail 376, tack 378 may be manually attached to any one of the attachment points 374. Conveniently, sheets or lines 382 are coupled to clew 380 to control the location of clew 380. Although not shown, it will be appreciated that the head of foresail 376 may be coupled to mast 26 using any of the attachment schemes described herein. Preferably, the head of foresail 376 will be coupled to mast 26 using a pivotal strut as described herein.

Figure 19:
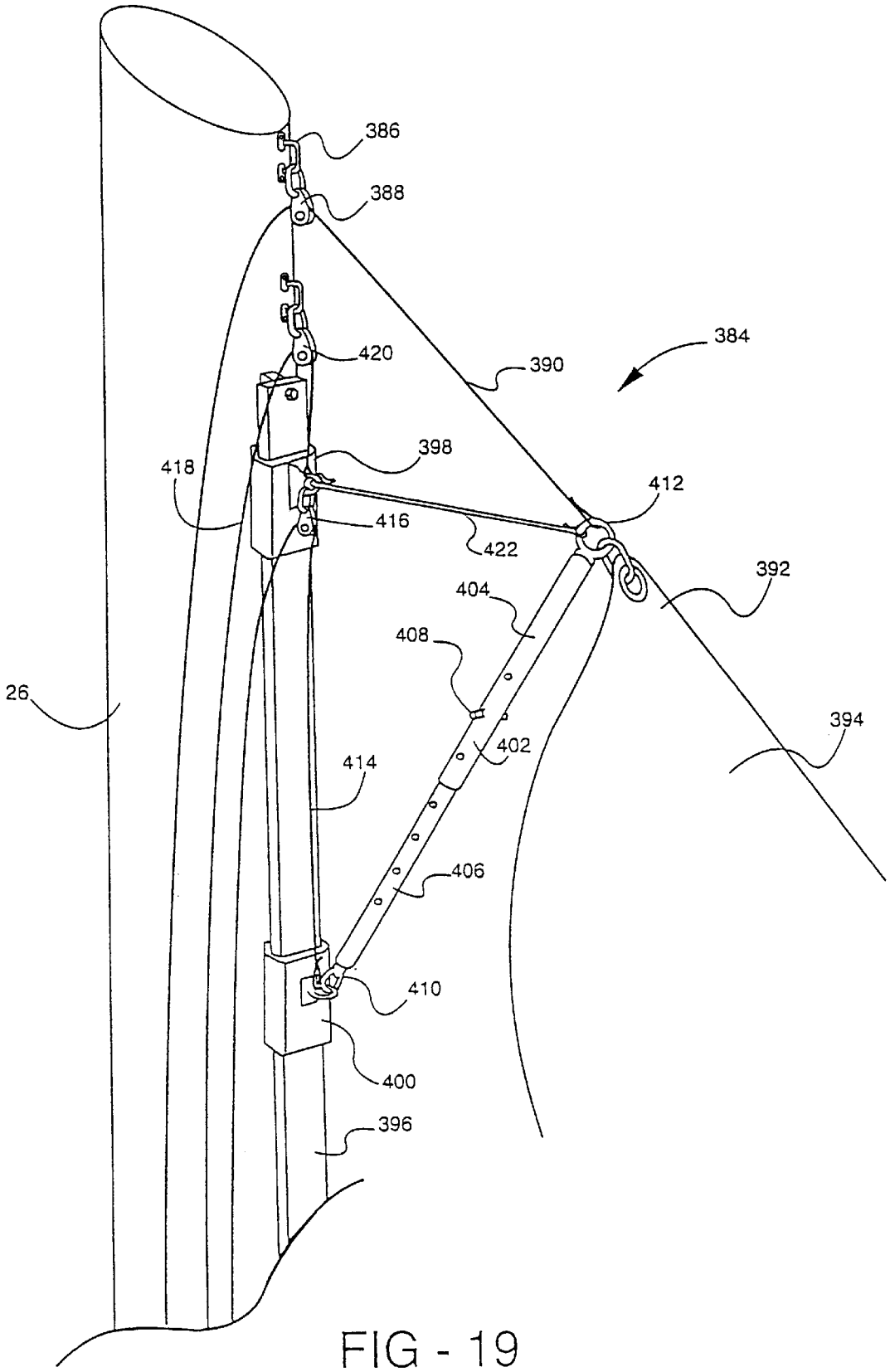
FIG. 19 illustrates a mast having a track to which a strut and a line are coupled to allow for the location of the head of a foresail to be adjusted according to the invention.

Referring now to FIG. 19, an alternative embodiment of a sailboat 384 having a mast 26 will be described. The features of sailboat 384 may be used in connection with any of the sailboats described herein. Mast 26 includes a connector 386 to which a forestay (not shown) may be coupled to secure mast 26 to the sailboat as is known in the art. Also coupled to connector 386 is a halyard 388. A line 390 passes around halyard 388 and is employed to raise a head 392 of a foresail 394.

Coupled to mast 26 is a track 396. Slidably coupled to track 396 are carriages 398 and 400. Carriage 400 is pivotally coupled to an adjustable strut 402. Strut 402 comprises a tubular section 404 for receiving a cylindrical section 406. The amount that section 406 may be extended from section 404 is determined by a pin 408. Section 406 includes a ring 410 which allows it to be pivotally coupled to carriage 400. Section 404 also includes a ring 412 which is coupled to head 392. In this way, the location of head 392 will adjust itself relative to mast 26 depending on the direction of the wind. Further, the length of strut 402 may be adjusted to further adjust the distance at which head 392 may be distanced from mast 26. Still further, a line 414 is coupled to carriage 400 and extends around a halyard 416 on carriage 398. In this way, carriage 400 may be raised or lowered relative to carriage 398.

Carriage 398 is raised and lowered by a line 418 that extends around a halyard 420. Extending between carriage 398 and ring 412 is a cable 422. Cable 422 is provided to control the offset of foresail 394 from mast 26. Use of cable 422 is particularly advantageous in facilitating the movement of foresail 394 between the port and starboard sides of the sailboat. In particular, when moving between the port and starboard sides, carriage 400 is lowered so that strut 402 will not engage the forestay when moving between port and starboard sides. Once on the other side of the forestay, carriage 400 is raised until cable 422 is again tensioned. In this manner, larger foresails may be provided without interfering with the forestay when changing the tack of the sail.

Figure 20:
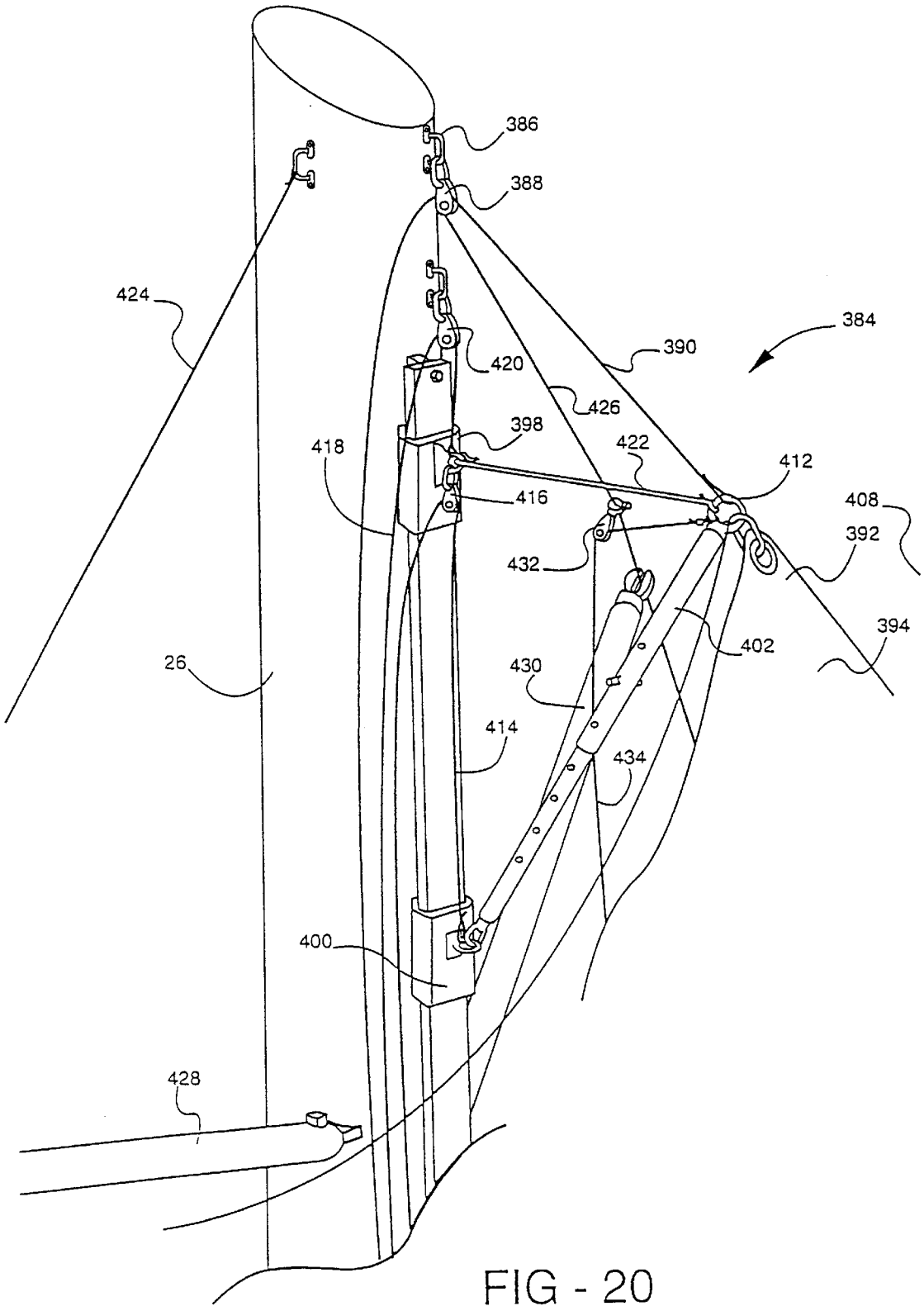
FIG. 20 illustrates the mast of FIG. 19 and further including a line which is coupled to a shroud to further assist in adjusting the location of the strut according to the invention.

Mast 26 may also be accommodated with a scheme to adjust the shape of foresail 394 by adjusting its tension as illustrated in FIG. 20. In FIG. 20, mast 26 is also supported by a shroud 424 on the starboard side and a shroud 426 on the port side. A pair of spreaders 428 and 430 are coupled to mast 26 to spread shrouds 424 and 426. A block 432 is coupled to shroud 426 (it being appreciated that a similar block may be coupled to shroud 424). A line 434 extends around block 432 and is coupled to ring 412 on strut 402. Line 434 may be manipulated to adjust the amount of tension on the luff of foresail 394 when positioned portside. A similar scheme may be provided to tension the luff of the foresail when located on the starboard side. Line 434 is particularly advantageous in that it allows for the shape of the foresail to be adjusted merely by varying the tension in line 434.

Figure 21:
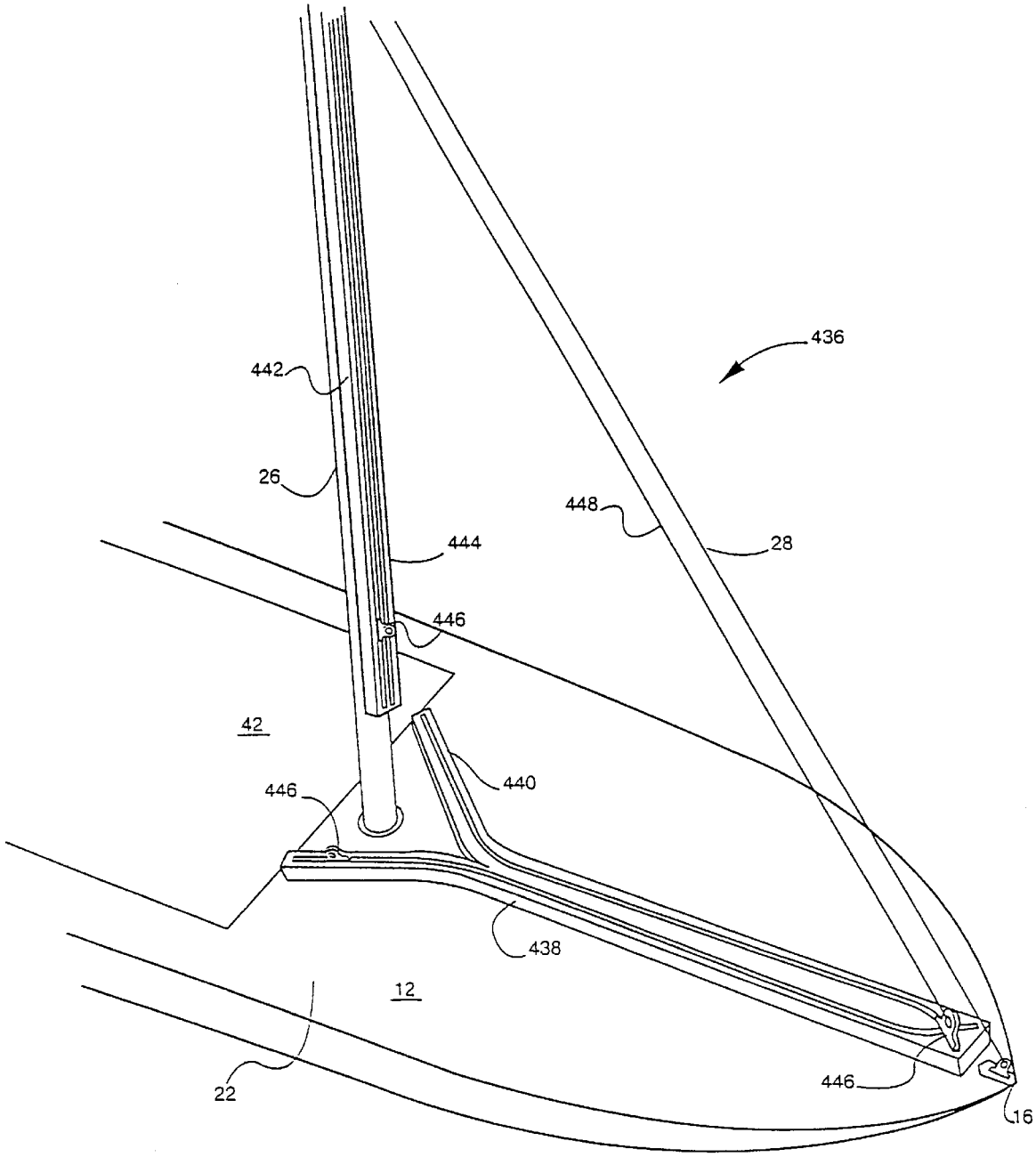
FIG. 21 illustrates an embodiment of a sailboat having a pair of tracks along a deck, with the tracks crossing each other at a longitudinal axis of the sailboat according to the invention.

Referring now to FIG. 21, another alternative embodiment of a sailboat 436 will be described. Sailboat 436 is similar to the embodiment of FIG. 11 and includes a starboard deck track 438 and a port deck track 440. Mast 26 includes a starboard mast track 442 and a port mast track 444. Each of tracks 438–440 is provided with a carriage 446 to which a luff cable 448 may be attached to allow the foresail to be raised and lowered in a manner similar to that previously described. As illustrated in FIG. 21, deck tracks 438 and 440 cross each other at a center line or longitudinal axis (see axis 18 of FIG. 1) of deck 12. In this way, when carriage 446 is moved to the end of its track, the foresail will be fully raised and the tack of the foresail will be directly on the center line of the sailboat.

Figure 22:
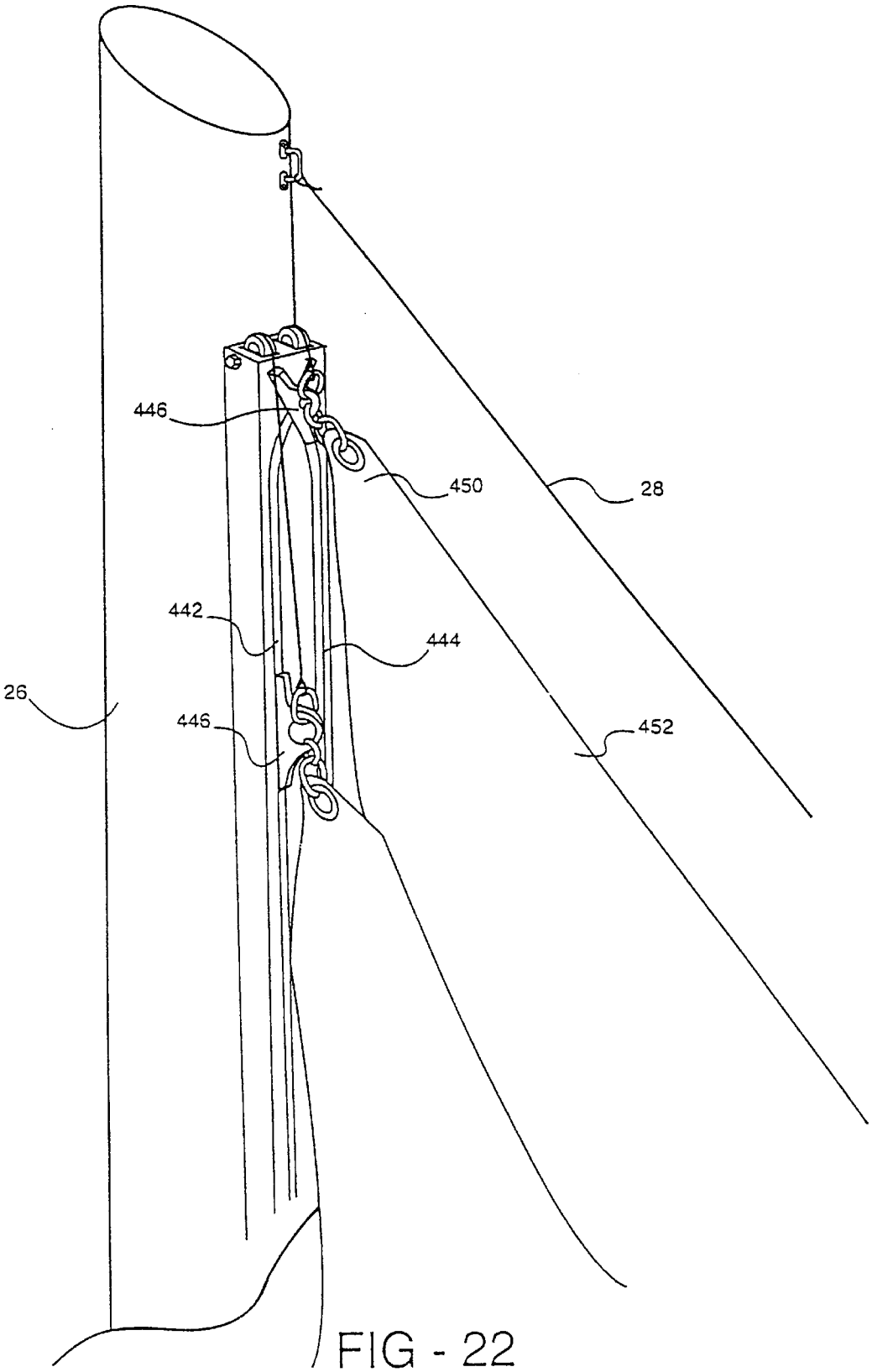
FIG. 22 illustrates the mast of the sailboat of FIG. 21 showing a pair of tracks which cross each other at a point that is aligned with the longitudinal axis of the sailboat according to the invention.

As illustrated in FIG. 22, mast tracks 442 and 444 also cross each other at a point that is aligned with the center line of the sailboat. In this way, a head 450 of a foresail 452 will be aligned with the center line when the foresail is fully raised.

Figure 23:
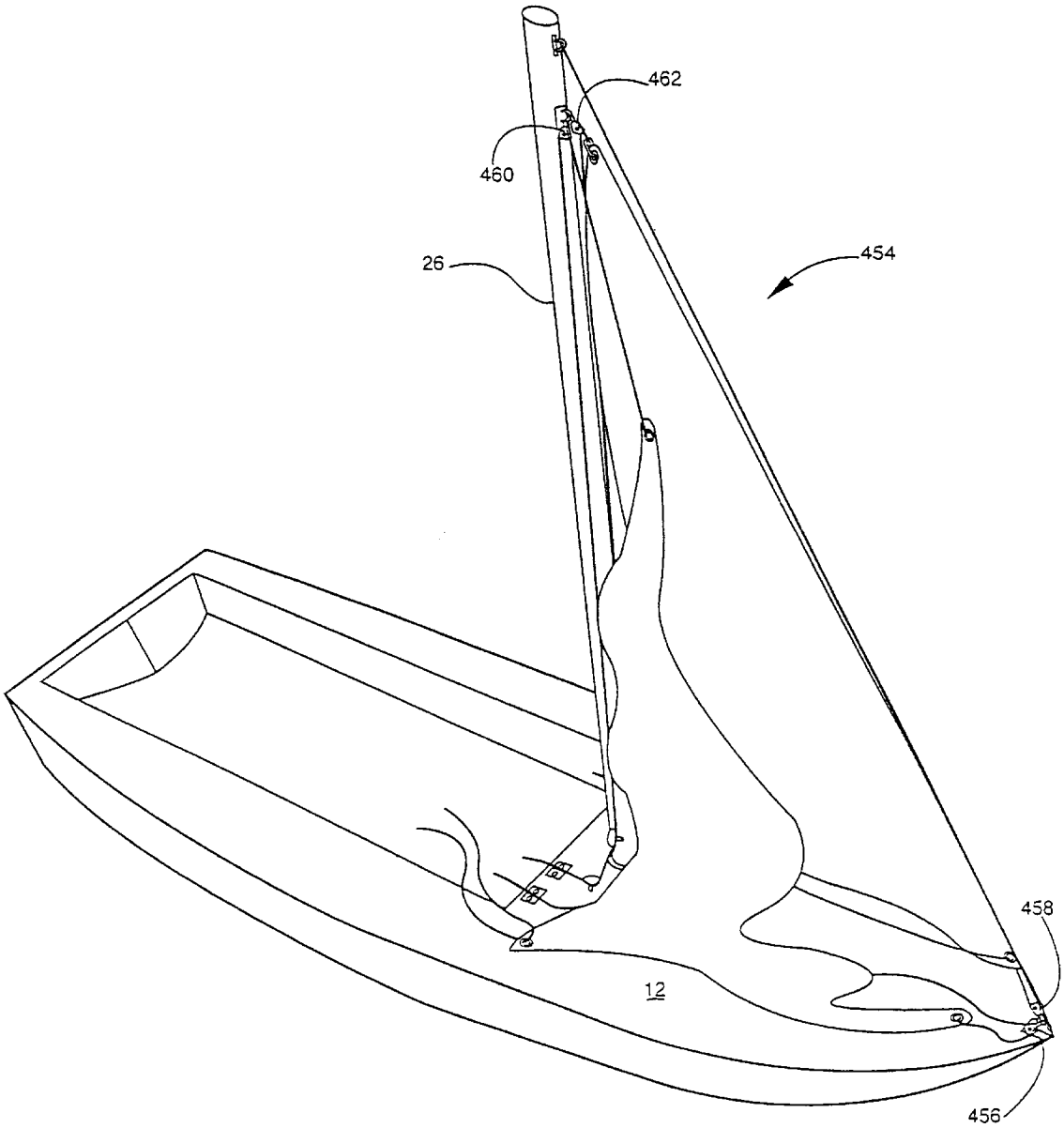
FIG. 23 illustrates a further alternative embodiment of a sailboat having a pair of pulleys attached to the mast and to the deck to facilitate the raising and lowering of two separate sails according to the invention.

Turning now to FIG. 23, still another alternative embodiment of a sailboat 454 will be described. Sailboat 454 includes a pair of pulleys 456 and 458 which are attached to deck 12 on the center line. Mast 26 also includes a pair of pulleys 460 and 462 that are attached at a point that is aligned with the center line of the boat. In this way, two sails may be separately raised and lowered so that one sail will always remain operable. Further, when raised, each of the sails will be aligned with a center line of the sailboat.

Figure 24:
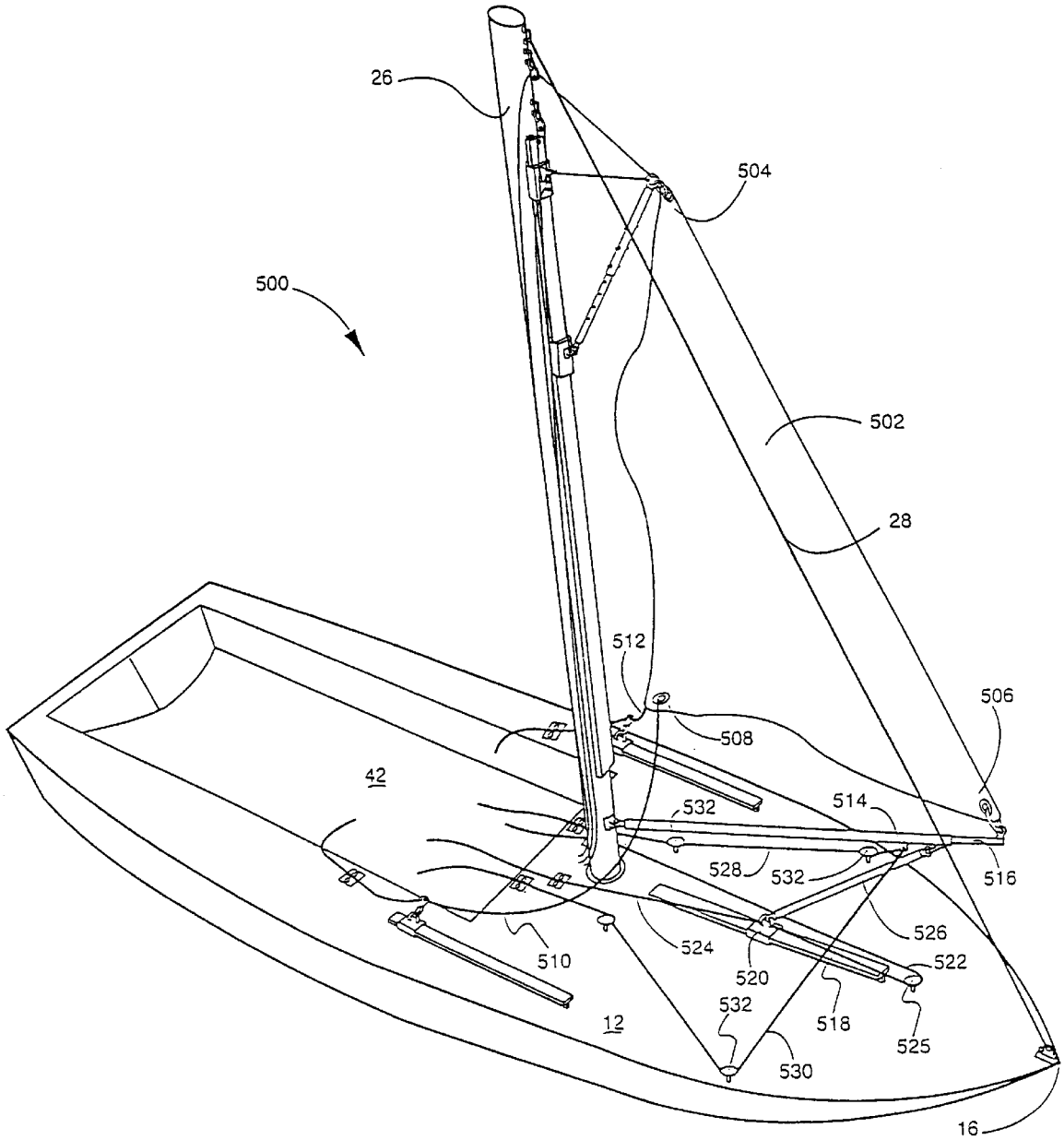
FIG. 24 illustrates still a further alternative embodiment of a sailboat having a pivotable forestay boom to vary the location of the tack of the foresail according to the invention.

Referring now to FIG. 24, an alternative embodiment of a sailboat 500 will be described. Attached to mast 26 is a foresail 502 having a head 504, a tack 506 and a clew 508. Head 504 is movably attached to mast 26 using an adjustable strut similar to the system shown in FIG. 12 and will not be described further. However, it will be appreciated that head 504 may be coupled to mast 26 by any of the schemes described herein. Extending from clew 508 are a pair of sheets 510 and 512 which are employed to control the location of clew 508 in a manner similar to that described with previous embodiments.

Pivotally coupled to mast 26 is a boom 514. Extending from boom 514 is an extension 516. Tack 506 is attached to extension 516. In this way, the distance of tack 506 relative to mast 26 may be varied by translating extension 516 relative to boom 514. However, it will appreciated that in some cases extension 516 may not be needed and tack 506 may be directly coupled to the end of boom 514.

Mounted to deck 12 is a track 518 having a carriage 520. Movement of carriage 520 along track 518 is controlled by lines 522 and 524 in association with a sheave 525 and necessary cleats. Pivotally coupled to carriage 520 and boom 514 is a boom pole 526. Also coupled to boom 514 are lines 528 and 530. Lines 528 and 530 pass around appropriate blocks 532.

By providing boom 514, tack 506 is able to be moved off of the center line of boat 500. Boom pole 526 in combination with carriage 520 and track 518 are adjusted to hold boom 514 off of the center line. Further, lines 528 and 530 in combination with blocks 532 are employed to control the downward pressure on boom 514. In this manner, tack 506 may be moved to either side of the boat and held in a desired position. When it is desired to change the position of tack 506, carriage 520 is moved toward mast 26. If needed, extension 516 may be withdrawn so that tack 506 will not interfere with forestay 28. Optionally, lines 528 and 530 may be employed to move boom 514 to the other side of the boat. Carriage 520 is then moved away from mast 26 to hold boom 514 in the desired position.

Although boom 514 is shown as being straight in geometry, it will be appreciated that variations may be made in order to accommodate various features of boat 500. For example, in cases where a hatch is provided on the bow of boat 500, boom 514 may be moved vertically upward and include a dog leg so that it will not interfere with the opening of the hatch.

EXAMPLE

A Santana 23 boat was modified to include a track similar to the track of FIG. 14 and to have an adjustable strut similar to the strut of FIG. 12. The boat was sailed into a wind of approximately 15 knots. When the operating angle of the foresail was at approximately 22 degrees, the boat was able to sail offwind by approximately 23 degrees.

Traditional sailboats are only able to sail at approximately 45 degrees offwind. Hence the boat of this example was able to improve the degree of travel into the wind by 22 degrees. Further, it is anticipated that as the operating angle is increased, the sailboats of the invention may be able to travel even closer to the direction of the wind. In this manner, the sailboats of the invention may be sailed in essentially any direction regardless of the direction of the wind.

The invention has now been described in detail for purposes of clarity and understanding. However, it will be appreciated that certain changes and modifications may be made within the scope of the invention. Therefore, the scope and content of this invention are not limited by the foregoing description. Rather, the scope and content are to be defined by the following claims.

What is claimed is:

1. A sailboat comprising:

a hull;

a deck operably attached to the hull, the deck having a longitudinal axis extending along a center of the deck;

at least one mast extending from the deck, the mast being generally aligned with the longitudinal axis;

a mainsail coupled to the mast, a single foresail having a head, a tack and a clew, and a luff extending between the head and the tack, wherein the head is operably coupled to the mast and the tack is operably coupled to the deck, with the head and the tack being movable in directions that are different from a longitudinal direction defined by the longitudinal axis; and a system to permit movement of the head and the tack relative to the longitudinal axis independent of movement of the mainsail.

2. A sailboat as in claim 1, further comprising a luff cable operably coupled to the mast and the deck, and wherein the foresail is coupled to the luff cable between the head and the tack.

3. A sailboat as in claim 2, further comprising a track operably attached to the deck and a carriage arranged to move along the track, and wherein the luff cable is coupled to the carriage to allow the tack of the foresail to adjust its orientation in the wind as the carriage moves along the track.

4. A sailboat as in claim 2, further comprising a turret rotatably coupled to the deck and an arm translatably coupled to the turret, wherein the luff cable is coupled to the arm to allow the tack of the foresail to be moved rotationally and radially relative to the turret.

5. A sailboat as in claim 2, further comprising a plurality of attachment points on the deck which are offset from the longitudinal axis, wherein the luff cable is selectively attachable to each of the attachment points.

6. A sailboat as in claim 1, wherein the hull has a port side and a starboard side, and further comprising a sprit pole extending from the port side and the starboard side and a line extending between the sprit poles, and wherein the tack is movably coupled to the line.

7. A sailboat as in claim 6, wherein the sprit poles are translatable relative to the hull.

8. A sailboat as in claim 1, further comprising a boom coupled to the mainsail, and a boom pole coupled to the boom to adjust the orientation of the mainsail.

9. A sailboat as in claim 1, further comprising a track disposed on the mast, a strut movably and pivotally coupled at one end to the mast track and at another end to the head of the foresail, and a cable coupled to the mast track at a location different from the strut and to the head of the foresail, wherein the strut is movable along the track relative to the cable to adjust the position of the head of the foresail relative to the mast.

10. A sailboat as in claim 1, further comprising at least one shroud coupled to the mast and the deck, further comprising a strut pivotally coupled at one end to the mast and at another end to the head of the foresail, and further comprising a line coupled to the shroud and the strut, wherein the line is movable to adjust the position of the head of the foresail relative to the mast.

11. A sailboat comprising:

a hull;

a deck operably attached to the hull, the deck having a longitudinal axis extending along a center of the deck;

at least one mast extending from the deck, the mast being generally aligned with the longitudinal axis;

a mainsail coupled to the mast;

a boom pivotally coupled to the mast; and a single foresail having a head, a tack and a clew, and a luff extending between the head and the tack, wherein the head is operably coupled to the mast and the tack is operably coupled to the boom to permit the foresail to be moved independent of the mainsail when the boom is pivoted, with the tack being movable in an operating direction that is different from a longitudinal direction defined by the longitudinal axis upon pivoting of the boom about the mast, and wherein the head is movable in a direction that is different from the longitudinal direction.

12. A sailboat as in claim 11, wherein the boom includes a movable extension and the tack is coupled to the extension.

13. A sailboat as in claim 11, further comprising a track coupled to the deck, a carriage coupled to the track, and a boom pole pivotally coupled to the boom and the carriage.

14. A sailboat as in claim 13, further comprising a mechanism for moving the carriage along the track.

15. A sailboat as in claim 1, further comprising a boom pole pivotally coupled to the mast, and wherein the tack of the foresail is operably coupled to the boom pole.

16. A sailboat comprising:

a hull;

a deck operably attached to the hull, the deck having a longitudinal axis extending along a center of the deck;

at least one mast generally aligned with the longitudinal axis;

a main sail operably coupled to the mast;

a single foresail having a head, a tack, and a clew, and a luff extending between the head and the tack, wherein the head is operably coupled to the mast, with the head and the tack being movable relative to the longitudinal axis to permit the head and the tack to be moved to a windward side of the sailboat such that wind may engage the foresail and not be substantially blocked by the main sail when traveling downwind; and a system to move the head and the tack relative to the longitudinal axis independent of the direction of the wind and independent of movement of the mainsail.

17. A sailboat as in claim 16, further comprising a luff cable coupled to the mast and the deck, the luff cable being movable relative to the longitudinal axis such that the luff cable is movable fore and aft, wherein at least a portion of the foresail is movable fore and aft upon movement of the luff cable.

18. A sailboat as in claim 17, wherein the foresail is coupled to the luff cable between the head and the tack.

19. A sailboat as in claim 18, wherein the luff cable is movably coupled to the deck to allow the tack to be movable toward and away from the longitudinal axis.

20. A sailboat as in claim 18, wherein the luff cable is movably coupled to the mast to allow the head to be movable toward and away from the longitudinal axis.

21. A sailboat as in claim 18, wherein the luff cable is movably coupled to the deck to allow the tack to be movable toward and away from the longitudinal axis, and wherein the luff cable is movably coupled to the mast to allow the head to be movable toward and away from the longitudinal axis.

22. A sailboat as in claim 17, further comprising a track operably attached to the deck, with at least a portion of the track being at an angle relative to the longitudinal axis, and wherein the luff cable is coupled to the track.

23. A sailboat as in claim 22, wherein the track is disposed about a periphery of the deck, and wherein the luff is coupled to the track by a carriage.

24. A sailboat as in claim 16, further comprising a track operably attached to the mast to raise and lower the head relative to the mast.

25. A sailboat as in claim 24, further comprising an adjustment mechanism coupled to the mast track to vary the location of the luff relative to the longitudinal axis.

26. A sailboat as in claim 25, wherein the adjustment mechanism comprises a cross member having a track to which the head may be operably coupled, and wherein the cross member is movably coupled to the mast track.

27. A sailboat as in claim 26, further comprising a pair of tracks aligned with and coupled to the mast and a pair of tracks disposed on the deck to permit said single foresail to be lowered and another foresail to be raised.

28. A sailboat as in claim 26, further comprising a headstay or a forestay extending from the mast to the deck, the headstay or the forestay being aligned with the longitudinal axis.

29. A sailboat as in claim 25, wherein the adjustment mechanism comprises a pivotable strut coupled to the mast track.

* * * * *